US008405576B2

(12) United States Patent
Makino et al.

(10) Patent No.: US 8,405,576 B2
(45) Date of Patent: Mar. 26, 2013

(54) PLASMA DISPLAY DEVICE AND PLASMA DISPLAY PANEL DRIVING METHOD

(75) Inventors: Kosuke Makino, Osaka (JP); Taku Okada, Osaka (JP); Shinichiro Hashimoto, Osaka (JP); Kenji Ogawa, Osaka (JP); Shigeo Kigo, Osaka (JP)

(73) Assignee: Panasonic Corporation, Osaka (JP)

( * ) Notice: Subject to any disclaimer, the term of this patent is extended or adjusted under 35 U.S.C. 154(b) by 227 days.

(21) Appl. No.: 12/447,687

(22) PCT Filed: Apr. 14, 2008

(86) PCT No.: PCT/JP2008/000969

§ 371 (c)(1),
(2), (4) Date: Apr. 29, 2009

(87) PCT Pub. No.: WO2008/136180

PCT Pub. Date: Nov. 13, 2008

(65) Prior Publication Data

US 2010/0053134 A1 Mar. 4, 2010

(30) Foreign Application Priority Data

Apr. 26, 2007 (JP) ..... 2007-116925

(51) Int. Cl.
*G09G 3/28* (2006.01)

(52) U.S. Cl. ..... 345/63; 345/68

(58) Field of Classification Search ..... 345/63, 345/67, 68, 70; 315/169.4; 313/582
See application file for complete search history.

(56) References Cited

U.S. PATENT DOCUMENTS

| | | | | |
|---|---|---|---|---|
| 6,369,781 | B2 * | 4/2002 | Hashimoto et al. | 345/60 |
| 6,628,087 | B2 * | 9/2003 | Roh et al. | 315/169.3 |
| 6,686,912 | B1 * | 2/2004 | Kishi et al. | 345/211 |
| 6,803,888 | B1 * | 10/2004 | Nakamura et al. | 345/60 |
| 6,853,144 | B2 * | 2/2005 | Marcotte | 315/169.1 |
| 6,900,598 | B2 * | 5/2005 | Hibino et al. | 315/169.4 |
| 7,242,373 | B2 * | 7/2007 | Tomio et al. | 345/60 |
| 7,852,295 | B2 * | 12/2010 | Lee et al. | 345/67 |
| 2003/0057851 | A1 * | 3/2003 | Roh et al. | 315/169.2 |

(Continued)

FOREIGN PATENT DOCUMENTS

| | | | |
|---|---|---|---|
| JP | 2005-338120 | A | 12/2005 |
| WO | WO 2004/055770 | A1 | 7/2004 |

(Continued)

OTHER PUBLICATIONS

International Search Report for PCT/JP2008/000969, May 20, 2008.

*Primary Examiner* — Jeff Piziali
(74) *Attorney, Agent, or Firm* — RatnerPrestia

(57) ABSTRACT

A sustain pulse generation circuit of a plasma display device generates and switches a first sustain pulse for causing light emission having double peaks, a second sustain pulse having a falling edge steeper than that of the first sustain pulse, and a third sustain pulse having a rising edge and a falling edge steeper than those of the first sustain pulse and causing light emission having a single peak. The second sustain pulse or the third sustain pulse is generated immediately before the third sustain pulse. The first sustain pulse is generated immediately before the second sustain pulse. Provided between the second sustain pulse and the third sustain pulse and between the third sustain pulses is a first overlap period in which a time period for causing the corresponding sustain pulse to rise is overlapped with a time period for causing the corresponding sustain pulse to fall.

4 Claims, 15 Drawing Sheets

U.S. PATENT DOCUMENTS

| | | | | |
|---|---|---|---|---|
| 2003/0174102 | A1* | 9/2003 | Jeong | 345/60 |
| 2005/0168404 | A1* | 8/2005 | Ogawa et al. | 345/60 |
| 2005/0168410 | A1* | 8/2005 | Tomio et al. | 345/60 |
| 2007/0052626 | A1* | 3/2007 | Kim et al. | 345/68 |

FOREIGN PATENT DOCUMENTS

| | | | |
|---|---|---|---|
| WO | WO 2006/123599 | A1 | 11/2006 |
| WO | WO 2008/007618 | A1 | 1/2008 |

* cited by examiner

FIG. 13

| Light-emitting rate (%) | First sustain pulse | | Second sustain pulse | | Third sustain pulse | | Fourth sustain pulse | | First overlap period T × 1 | Second overlap period T × 2 |
|---|---|---|---|---|---|---|---|---|---|---|
| | Rising period | Falling period | Rising period | Falling period | Rising period | Falling period | Rising period | Falling period | | |
| 85%~ | SCi 550 nsec<br>SUi 500 nsec | 900 nsec | SCi 550 nsec<br>SUi 500 nsec | 400 nsec | 350 nsec | 400 nsec | 350 nsec | 900 nsec | 50 nsec | 0 nsec |
| 50%~ 85% | 550 nsec | 1000 nsec | 550 nsec | 400 nsec | 350 nsec | 400 nsec | 350 nsec | 1000 nsec | 50 nsec | 100 nsec |
| 20%~ 50% | 500 nsec | 1000 nsec | 500 nsec | 400 nsec | 350 nsec | 400 nsec | 350 nsec | 1000 nsec | 50 nsec | 0 nsec |
| ~20% | 450 nsec | 1000 nsec | 450 nsec | 400 nsec | 350 nsec | 400 nsec | 350 nsec | 1000 nsec | 50 nsec | 0 nsec |

PLASMA DISPLAY DEVICE AND PLASMA DISPLAY PANEL DRIVING METHOD

This application is a U.S. National Phase Application of PCT International Application PCT/JP2008/000969.

TECHNICAL FIELD

The present invention relates to a plasma display device and a plasma display panel driving method for use in a wall-mounted television or a large monitor.

BACKGROUND ART

An alternating-current surface-discharging panel representative of a plasma display panel (hereinafter abbreviated as "panel") has a large number of discharge cells that are formed between the front plate and the rear plate faced to each other. For the front plate, a plurality of display electrode pairs, each made of a scan electrode and a sustain electrode, are formed on a front glass substrate in parallel with each other. A dielectric layer and a protective layer are formed to cover these display electrode pairs. For the rear plate, a plurality of parallel data electrodes are formed on a rear glass substrate and a dielectric layer is formed over the data electrodes to cover them. Further, a plurality of barrier ribs are formed on the dielectric layer in parallel with the data electrodes. Phosphor layers are formed over the surface of the dielectric layer and the side faces of the barrier ribs. Then, the front plate and the rear plate are faced to each other and sealed together so that the display electrode pairs are intersected with data electrodes. A discharge gas containing xenon in a partial pressure ratio of 5%, for example, is charged in the inside discharge space formed between the plates. Discharge cells are formed in portions where the display electrode pairs are faced to the data electrodes. For a panel structured as above, gas discharge generates ultraviolet light in each discharge cell. This ultraviolet light excites the red (R), green (G), and blue (G) phosphors so that they emit the corresponding colors for color display.

A general method for driving a panel is a subfield method: one field period is divided into a plurality of subfields and combinations of light-emitting subfields provide gradation display.

Each subfield has an initializing period, an address period, and a sustain period. In the initializing period, initializing discharge is caused to form wall charge necessary for the succeeding address operation on the respective electrodes and to generate priming particles (priming for discharge=exciting particles) for causing stable address discharge. In the address period, an address pulse voltage is applied selectively to the discharge cells to be lit, to cause address discharge and form wall charge (hereinafter, this operation being also referred to as "addressing"). In the sustain period, a sustain pulse voltage is applied alternately to display electrode pairs, each made of a scan electrode and a sustain electrode, to cause sustain discharge in the discharge cells having generated address discharge and to cause light emission of the phosphor layers in the corresponding discharge cells. Thus, an image is displayed.

On the other hand, with recent increases in the definition and screen size of panels, various efforts are made to improve the emission efficiency and luminance of the panels. For example, studies are made on considerable improvement of the emission efficiency by increasing the xenon partial pressure. However, a higher xenon partial pressure causes greater variations in the discharge generation timing. This can cause variations in the emission intensity between discharge cells and makes the display luminance nonuniform. Disclosed to improve this nonuniform luminance is a driving method in which insertion of a sustain pulse having a steeper rising edge once out of a plurality of times, for example, matches the sustain discharge timings and thus uniformizes the display luminance. Such a method is disclosed in Patent Document 1, for example.

However, at a xenon partial pressure increased to enhance the emission efficiency, a so-called phenomenon of afterimage is likely to occur. The phenomenon of afterimage is perception of a still image when an image having high luminance is displayed after the still image is displayed for an extended period of time. This phenomenon poses a new problem of affecting the image display quality.

[Patent Document 1] Japanese Patent Unexamined Publication No. 2005-338120

SUMMARY OF THE INVENTION

The present invention provides a plasma display device and a panel driving method capable of alleviating a phenomenon of afterimage, uniformizing the display luminance of respective discharge cells, and providing an excellent image display quality.

The plasma display device includes the following elements: a plasma display panel that includes a plurality of discharge cells each including a display electrode pair made of a scan electrode and a sustain electrode; a power recovery circuit for causing a sustain pulse to rise or fall by producing resonance between the interelectrode capacitance of the display electrode pairs and an inductor; a clamp circuit for clamping the voltage of the sustain pulse to a power supply voltage or a base potential; and a sustain pulse generation circuit for generating the sustain pulse at the number of times corresponding to a brightness weight and applying the sustain pulse alternately to the display electrode pairs in a sustain period. One field period includes a plurality of subfields. Each of the subfield includes an initializing period, an address period, and the sustain period. In the sustain period, the sustain pulse generation circuit generates and switches the following at least three types of sustain pulse: a first sustain pulse, which is to be a reference pulse, for causing light emission having double peaks in the discharge cells; a second sustain pulse having a falling edge steeper than that of the first sustain pulse; and a third sustain pulse that has a rising edge and a falling edge steeper than those of the first sustain pulse and causes light emission having a single peak in the discharge cells. The sustain pulse generation circuit generates the second sustain pulse or the third sustain pulse immediately before the third sustain pulse. The sustain pulse generation circuit generates the first sustain pulse immediately before the second sustain pulse. The sustain pulse generation circuit provides, between the second sustain pulse and the third sustain pulse and between the third sustain pulse and the third sustain pulse, a first overlap period in which the time period for causing the corresponding sustain pulse to fall is overlapped with the time period for causing the corresponding sustain pulse to rise.

The plasma display panel driving method includes the following steps, in a method for driving a plasma display panel that includes a plurality of discharge cells each including a display electrode pair made of a scan electrode and a sustain electrode. One field period includes a plurality of subfields. Each of the subfields includes an initializing period, an address period, and a sustain period. Generated and switched in the sustain period are the following at least three types of sustain pulse: a first sustain pulse, which is to be a reference pulse, for causing light emission having double peaks in the discharge cells; a second sustain pulse having a falling edge steeper than that of the first sustain pulse; a third sustain pulse that has a rising edge and a falling edge steeper than those of the first sustain pulse and causes light emission having a single peak in the discharge cells. The second sustain pulse or the third sustain pulse is generated immediately before the third sustain pulse. The first sustain pulse is generated immediately before the second sustain pulse. Provided between the second sustain pulse and the third sustain pulse and between the third sustain pulse and the third sustain pulse is a first overlap period in which the time period for causing the corresponding sustain pulse to fall is overlapped with the time period for causing the corresponding sustain pulse to rise.

BRIEF DESCRIPTION OF THE DRAWINGS

FIG. 13 is a table showing an example of the relation between light-emitting rates and the respective sustain pulses in accordance with the second exemplary embodiment of the present invention.

REFERENCE MARKS IN THE DRAWINGS

Figure 1:
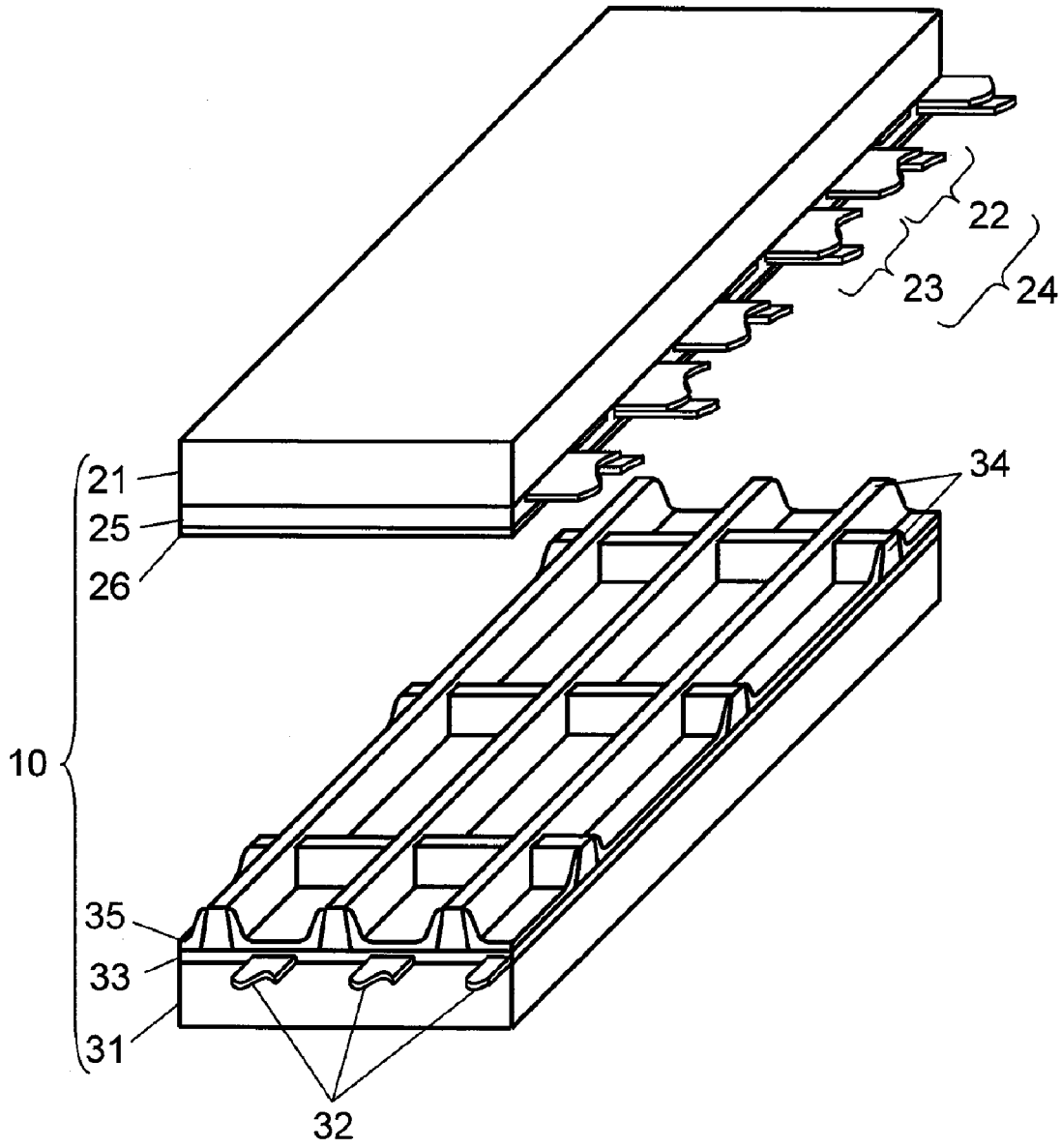
FIG. 1 is an exploded perspective view illustrating a structure of a panel in accordance with a first exemplary embodiment of the present invention.

1, 101 Plasma display device
10 Panel
21 (Glass) front plate
22 Scan electrode
23 Sustain electrode
24 Display electrode pair
25, 33 Dielectric layer
26 Protective layer
31 Rear plate
32 Data electrode
34 Barrier rib
35 Phosphor layer
41 Image signal processing circuit
42 Data electrode driver circuit
43 Scan electrode driver circuit
44 Sustain electrode driver circuit
45 Timing generation circuit
48 Light-emitting rate detection circuit
50, 60 Sustain pulse generation circuit
51, 61 Power recovery circuit
52, 62 Clamp circuit
53 Initializing waveform generation circuit
54 Scan pulse generation circuit
55 First Miller integrator circuit
56 Second Miller integrator circuit
57 Third Miller integrator circuit
Q1, Q2, Q3, Q4, Q11, Q12, Q13, Q14, Q15, Q16, Q21, Q31, Q32, Q33, Q34, Q36, Q37, Q38, Q39, QH1 to QHn, QL1 to QLn Switching element
C1, C10, C11, C12, C21, C30, C31 Capacitor
L1, L30 Inductor
D1, D2, D12, D13, D21, D31, D32, D33 Diode
AG AND Gate
CP Comparator
R10, R11, R12, R13, R14 Resistor

DETAILED DESCRIPTION OF PREFERRED EMBODIMENTS

Hereinafter, a description is provided of a plasma display device in accordance with exemplary embodiments of the present invention, with reference to the accompanying drawings.

First Exemplary Embodiment

FIG. 1 is an exploded perspective view illustrating a structure of panel 10 in accordance with the first exemplary embodiment of the present invention. A plurality of display electrode pairs 24, each made of scan electrode 22 and sustain electrode 23, are formed on glass front plate 21. Dielectric layer 25 is formed to cover scan electrodes 22 and sustain electrodes 23. Protective layer 26 is formed over dielectric layer 25.

In order to lower the breakdown voltage in discharge cells, protective layer 26 is made of a material predominantly composed of MgO. MgO has proven performance as a panel material, and exhibits a large secondary electron emission coefficient and excellent durability when neon (Ne) and xenon (Xe) gas is charged.

A plurality of data electrodes 32 are formed on rear plate 31. Dielectric layer 33 is formed to cover data electrodes 32. Further, on the dielectric layer, barrier ribs 34 are formed in a double cross. Over the side faces of barrier ribs 34 and dielectric layer 33, phosphor layers 35 for emitting red (R), green (G), and blue (B) light are provided.

These front plate 21 and rear plate 31 are faced to each other sandwiching a small discharge space therebetween so that display electrode pairs 24 are intersected with data electrodes 32. The outer peripheries of the plates are sealed with a sealing material, such as a glass frit. In the inside discharge space, a mixed gas of neon and xenon is charged as a discharge gas. In this exemplary embodiment, a discharge gas having a xenon partial pressure of approximately 10% is used to improve the emission efficiency. The discharge space is partitioned into a plurality of compartments by barrier ribs 34. Discharge cells are formed at intersections between display electrode pairs 24 and data electrodes 32. Discharging and lighting in these discharge cells allows image display.

The structure of panel 10 is not limited to the above, and may include stripe-like barrier ribs, for example. The mixing ratio of the discharge gas is not limited to the above value, and the other mixing ratios can be used.

Figure 2:
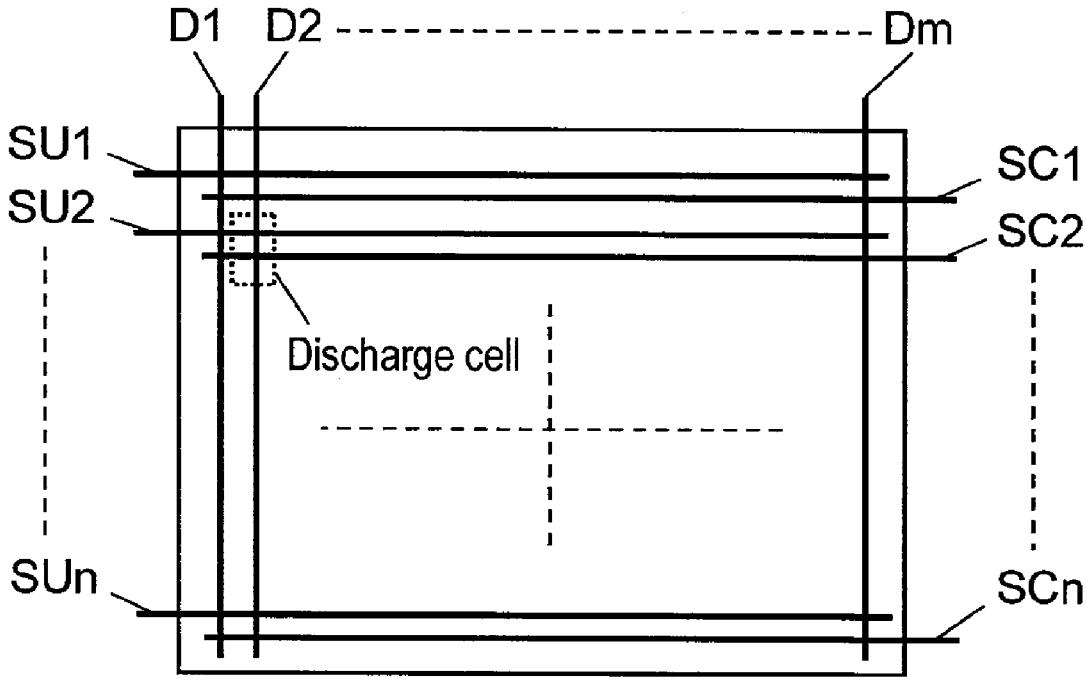
FIG. 2 is a diagram showing an array of electrodes of the panel.

FIG. 2 is a diagram showing an array of electrodes of panel 10 in accordance with the first exemplary embodiment of the present invention. Panel 10 includes n scan electrodes SC1 to SCn (scan electrodes 22 in FIG. 1) and n sustain electrodes SU1 to SUn (sustain electrodes 23 in FIG. 1) both long in the row direction, and m data electrodes D1 to Dm (data electrodes 32 in FIG. 1) long in the column direction. A discharge cell is formed in the portion where a pair of scan electrode SCi (i=1 to n) and sustain electrode SUi is intersected with one data electrode Dj (j=1 to m). Thus, m×n discharge cells are formed in the discharge space. As shown in FIG. 1 and FIG. 2, scan electrode SCi and sustain electrode SUi are formed in pairs in parallel with each other. Thus, large interelectrode capacitance Cp exists between scan electrodes SC1 to SCn and sustain electrodes SU1 to SUn.

Next, drive voltage waveforms for driving panel 10 are described and the operation thereof is outlined. A plasma display device of this exemplary embodiment provides gradation display by a subfield method: one field period is divided into a plurality of subfields and whether to light the respective discharge cells or not is controlled for each of the subfields. Each subfield has an initializing period, an address period, and a sustain period.

For each subfield, in the initializing period, initializing discharge is caused to form wall charge necessary for the succeeding address discharge, on the respective electrodes. Additionally generated are priming particles (priming for discharge=excited particles) for reducing discharge delay and causing stable address discharge. The initializing operations performed at this time include an all-cell initializing operation for causing initializing discharge in all the discharge cells, and a selective initializing operation for selectively causing initializing discharge only in the discharge cells having generated sustain discharge in the preceding subfield (SF).

In the address period, address discharge is caused to form wall charge selectively in the discharge cells to be lit in the succeeding sustain period. In the sustain period, alternate application of a number of sustain pulses proportional to the brightness weight to display electrode pairs 24 causes sustain discharge for light emission in the discharge cells having generated address discharge. This proportionality factor is called "luminance factor".

In the first exemplary embodiment, one field is divided into 10 SFs (the first SF, and second SF to tenth SF), and the respective subfields have different brightness weights (e.g. 1, 2, 3, 6, 11, 18, 30, 44, 60, and 80). The all-cell initializing operation is performed in the initializing period of the first SF, and the selective initializing operation is performed in the initializing periods of the second to 10th SFs. In this subfield structure, the light emission unrelated to image display is only the light emission caused by the discharge in the all-cell initializing operation in the first SF. Thus, a black picture level, i.e. luminance in a black display area generating no sustain discharge, is provided only by weak light emission in the all-cell initializing operation. As a result, an image having high contrast can be displayed. In the sustain period of each subfield, sustain pulses in a number equal to the brightness weight of the subfield multiplied by a predetermined luminance factor are applied to each of display electrode pairs 24.

However, in the present invention, the number of subfields and the brightness weight of each subfield are not limited to the above values. The subfield structure can be switched according to image signals or the like.

In the first exemplary embodiment, a ramp waveform voltage is generated at the end of each sustain period. This operation stabilizes the address operation in the address period of the succeeding subfield. Further, in the first exemplary embodiment, four types of sustain pulse are generated and switched in each sustain period. The pulses are as follows: a first sustain pulse, which is to be a reference pulse; a second sustain pulse having a falling edge steeper than that of the first sustain pulse; a third sustain pulse having a rising edge and a falling edge steeper than those of the first sustain pulse; and a fourth sustain pulse having a rising edge steeper than that of the first sustain pulse. Further, immediately after a sustain pulse having a steeper falling edge, a sustain pulse having a steeper rising edge is generated. This structure alleviates the phenomenon of afterimage. Hereinafter, first, a description is provided of the outline of the drive voltage waveforms and the structure of the driver circuits. Next, a detailed description is provided of the operation in each sustain period.

Figure 3:
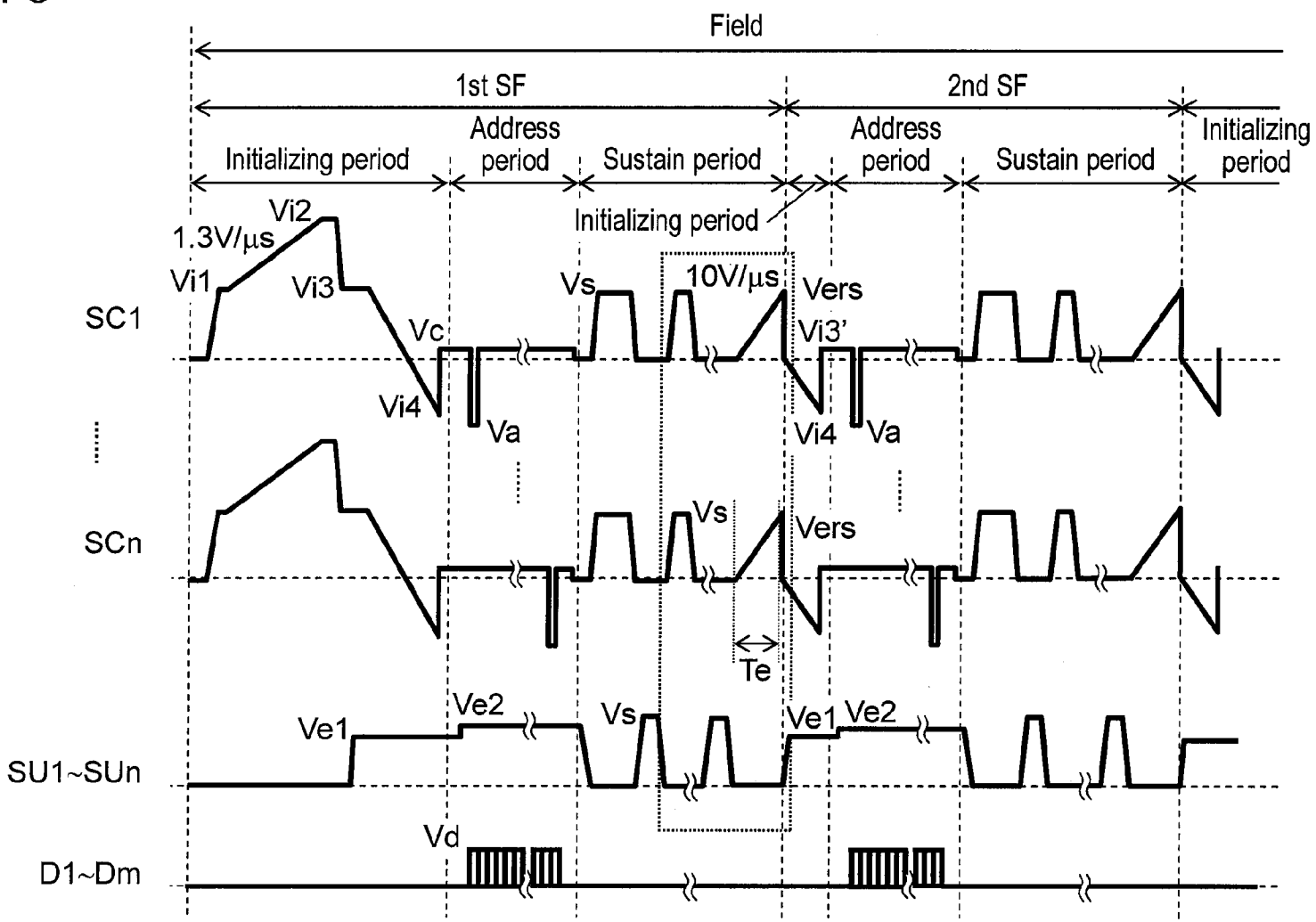
FIG. 3 is a waveform chart of drive voltages to be applied to the respective electrodes of the panel.

FIG. 3 is a waveform chart showing drive voltages to be applied to the respective electrodes of panel 10 in accordance with the first exemplary embodiment of the present invention. FIG. 3 shows drive voltage waveforms in two subfields, i.e. a subfield in which all-cell initializing operation is performed (hereinafter referred to as "all-cell initializing subfield") and a subfield in which selective initializing operation is performed (hereinafter "selective initializing subfield"). The drive voltage waveforms in the other subfields are similar to these waveforms. In the following descriptions, scan electrode SCi, sustain electrode SUi, and data electrode Dk show the electrodes selected from the respective electrodes according to image data.

First, a description is provided of the first SF, i.e. an all-cell initializing subfield. In the first half of the initializing period in the first SF, 0 (V) is applied to respective data electrodes D1 to Dm and sustain electrodes SU1 to SUn. Applied to scan electrodes SC1 to SCn is a first ramp waveform voltage (herein after referred to as "rising ramp waveform voltage") that gently rises from voltage Vi1 of a breakdown voltage or lower to voltage Vi2 exceeding the breakdown voltage with respect to sustain electrodes SU1 to SUn.

In the first exemplary embodiment, this rising ramp waveform voltage is generated at a gradient of approximately 1.3 V/μsec.

While this ramp waveform voltage is rising, weak initializing discharge continuously occurs between scan electrodes SC1 to SCn and sustain electrodes SU1 to SUn, and between scan electrodes SC1 to SCn and data electrodes D1 to Dm. Then, negative wall voltage accumulates on scan electrodes SC1 to SCn. Positive wall voltage accumulates on data electrodes D1 to Dm and sustain electrodes SU1 to SUn. The wall voltage on the electrodes means the voltage generated by the wall charge accumulated on the dielectric layers, protective layer, phosphor layers, or the like covering the electrodes.

In the second half of the initializing period, a positive voltage of Ve1 is applied to sustain electrodes SU1 to SUn. A voltage of 0 (V) is applied to data electrodes D1 to Dm. Applied to scan electrodes SC1 to SCn is a ramp waveform voltage (hereinafter referred to as "falling ramp waveform voltage") that gently falls from voltage Vi3 of the breakdown voltage or lower to voltage Vi4 exceeding the breakdown voltage with respect to sustain electrodes SU1 to SUn. During this application, weak initializing discharge continuously occurs between scan electrodes SC1 to SCn and sustain electrodes SU1 to SUn, and between scan electrodes SC1 to SCn and data electrodes D1 to Dm. This weak discharge weakens the negative wall voltage on scan electrodes SC1 to SCn and the positive wall voltage on sustain electrodes SU1 to SUn, and adjusts the positive wall voltage on data electrodes D1 to Dm to a value appropriate for the address operation. Thus, the all-cell initializing operation for causing initializing discharge in all the discharge cells is completed.

As shown in the initializing period in the second SF of FIG. 3, drive voltage waveforms in which the first half of the initializing period is omitted may be applied to the respective electrodes. In this case, voltage Ve1 is applied to sustain electrodes SU1 to SUn, 0 (V) is applied to data electrode D1 to Dm. A falling ramp waveform voltage gently falling from voltage Vi3' to voltage Vi4' is applied to scan electrodes SC1 to SCn. Such voltage application causes weak initializing discharge in the discharge cells having generated sustain discharge in the sustain period of the preceding subfield and weakens the wall voltage on scan electrode SCi and sustain electrode SUi. In the discharge cells in which sufficient positive wall voltage is accumulated on data electrode Dk (k=1 to m) by the preceding sustain discharge, an excessive part of this wall voltage is discharged and the wall voltage is adjusted appropriately for the address operation. On the other hand, in the discharge cells having generated no sustain discharge in the preceding subfield, no discharge occurs and the wall charge at the completion of the initializing period of the preceding subfield is maintained. In this manner, the initializing operation in which the first half is omitted is a selective initializing operation for causing initializing operation in the discharge cells subjected to sustain operation in the sustain period of the preceding subfield.

In the succeeding address period, first, voltage Ve2 is applied to sustain electrodes SU1 to SUn, and voltage Vc is applied to scan electrodes SC1 to SCn.

Next, negative scan pulse voltage Va is applied to scan electrode SC1 in the first row, and positive address pulse voltage Vd is applied to data electrode Dk (k=1 to m) of the discharge cell to be lit in the first row among data electrodes D1 to Dm. At this time, the voltage difference at the intersection between data electrode Dk and scan electrode SC1 is the addition of the difference in externally applied voltage (Vd−Va) and the difference between the wall voltage on data electrode Dk and the wall voltage on scan electrode SC1, thus exceeding the breakdown voltage. Then, discharge occurs between data electrodes Dk and scan electrode SC1. On the other hand, because voltage Ve2 is applied to sustain electrodes SU1 to SUn, the voltage difference between sustain electrode SU1 and scan electrode SC1 is the addition of the difference in externally applied voltage (Ve2−Va) and the difference between the wall voltage on sustain electrode SU1 and the wall voltage on scan electrode SC1. At this time, when voltage Ve2 is set to a voltage slightly lower than the breakdown voltage, discharge is likely to occur but not actually occurs between sustain electrode SU1 and scan electrode SC1. With this setting, discharge generated between data electrode Dk and scan electrode SC1 can trigger discharge between the areas of sustain electrode SU1 and scan electrode SC1 intersecting with data electrode Dk. In this manner, address discharge occurs in the discharge cells to be lit. Positive wall voltage accumulates on scan electrode SC1 and negative wall voltage accumulates on sustain electrode SU1. Negative wall voltage also accumulates on data electrode Dk.

In this manner, the address operation is performed to cause address discharge in the discharge cells to be lit in the first row, and to accumulate wall voltage on the corresponding electrodes. On the other hand, the voltage at the intersections between data electrodes D1 to Dm subjected to no address pulse voltage Vd and scan electrode SC1 does not exceed the breakdown voltage, thus causing no address discharge. The above address operation is performed on the discharge cells up to the n-th row and the address period is completed.

In the succeeding sustain period, first, positive sustain pulse voltage Vs is applied to scan electrodes SC1 to SCn, and a ground potential to be a base potential, i.e. 0 (V), is applied to sustain electrodes SU1 to SUn. Then, in the discharge cells having generated address discharge, the voltage difference between scan electrode SCi and sustain electrode SUi is the addition of sustain pulse voltage Vs and the difference between the wall voltage on scan electrode SCi and the wall voltage on sustain electrode SUi, thus exceeding the breakdown voltage.

Thus, sustain discharge occurs between scan electrode SCi and sustain electrode SUi, and ultraviolet light generated at this time causes phosphor layers 35 to emit light. Then, negative wall voltage accumulates on scan electrode SCi, and positive wall voltage accumulates on sustain electrodes SUi. Positive wall voltage also accumulates on data electrode Dk. In the discharge cells having generated no address discharge in the address period, no sustain discharge occurs and the wall voltage at the completion of the initializing period is maintained.

Next, a base potential of 0 (V) is applied to scan electrodes SC1 to SCn, and sustain pulse voltage Vs is applied to sustain electrodes SU1 to SUn. Then, in the discharge cell having generated sustain discharge, the voltage difference between sustain electrode SUi and scan electrode SCi exceeds the breakdown voltage, thereby causing sustain discharge between sustain electrode SUi and scan electrode SCi again. Thus, negative wall voltage accumulates on sustain electrode SUi, and positive wall voltage on scan electrode SCi. Similarly, sustain pulses in a number equal to the brightness weight multiplied by the luminance factor are applied alternately to scan electrodes SC1 to SCn and sustain electrodes SU1 to SUn to give a potential difference between the electrodes of each display electrode pair 24. Thereby, sustain discharge is continued in the discharge cells having generated address discharge in the address period.

As described above, in the first exemplary embodiment, four types of sustain pulse are generated and switched. The pulses are as follows: a first sustain pulse, which is to be a reference pulse; a second sustain pulse having a falling edge steeper than that of the first sustain pulse; a third sustain pulse having a rising edge and a falling edge steeper than those of the first sustain pulse; and a fourth sustain pulse having a rising edge steeper than that of the first sustain pulse. Further, immediately after a sustain pulse having a steeper falling edge, a sustain pulse having a steeper rising edge is generated. This structure alleviates the phenomenon of afterimage.

At the end of each sustain period, a second ramp waveform voltage (hereinafter referred to as "erasing ramp waveform voltage") that gently rises from a base potential of 0 (V) toward voltage Vers is applied to scan electrodes SC1 to SCn. This voltage application continuously causes weak discharge, and erases a part or the entire part of the wall voltage on scan electrode SCi and sustain electrode SUi while the positive wall voltage is left on data electrode Dk.

Specifically, after sustain electrodes SU1 to SUn are returned to 0 (V), an erasing ramp waveform voltage, i.e. the second ramp waveform voltage that rises from a base potential of 0 (V) toward voltage Vers exceeding the breakdown voltage is generated at a gradient of approximately 10 V/μsec, for example, which is steeper than that of the rising ramp waveform voltage as the first ramp waveform voltage, and applied to scan electrodes SC1 to SCn. Then, weak discharge occurs between sustain electrode SUi and scan electrode SCi in the discharge cell having generated sustain discharge. This weak discharge continuously occurs in the period during which the voltage applied to scan electrodes SC1 to SCn rises. Immediately after the rising voltage reaches voltage Vers, i.e. a predetermined potential, the voltage applied to scan electrodes SC1 to SCn is dropped to a base potential of 0 (V).

At this time, the charged particles generated by this weak discharge accumulate on sustain electrode SUi and scan electrode SCi as wall charge, to alleviate the voltage difference between sustain electrode SUi and scan electrode SCi. This accumulation weakens the wall voltage between scan electrodes SC1 to SCn and sustain electrodes SU1 to SUn to a degree of the difference between the voltage applied to scan electrode SCi and the breakdown voltage, i.e. voltage Vers—breakdown voltage, while the positive wall charge is left on data electrode Dk. Hereinafter, the last discharge generated by this erasing ramp waveform voltage in each sustain period is referred to as "erasing discharge".

In the first exemplary embodiment, immediately after the voltage applied to scan electrodes SC1 to SCn reaches a predetermined voltage of Vers, the voltage is dropped to a base potential of 0 (V). This structure is based on experimental results. According to the experimental results, when an rising voltage reaches a predetermined voltage of Vers and the voltage is kept thereafter, unusual discharge is likely to occur in the discharge cell satisfying one of the following conditions where:

the discharge cell is a non-luminous discharge cell (i.e. a discharge cell subjected to no address operation in the subfield);

an adjacent cell of the discharge cell is a luminous discharge cell (i.e. a discharge cell subjected to address operation in the subfield); and the discharge cell has generated sustain discharge in the preceding subfield.

Because this unusual discharge induces erroneous discharge in the succeeding address period, it is preferable to prevent the occurrence of the unusual discharge as much as possible. In the first exemplary embodiment, in generation of the erasing ramp waveform voltage, immediately after the voltage applied to scan electrodes SC1 to SCn has reached voltage Vers, the voltage is dropped to a base potential of 0 (V). With this structure, the wall voltage in the discharge cells can be adjusted optimum for stabilizing the succeeding address operation, while the occurrence of this unusual discharge is prevented.

The descriptions of the operation in the succeeding subfield are omitted, because this operation is substantially similar to the above operation except for the number of sustain pulses in the sustain period. The above descriptions have outlined drive voltage waveforms to be applied to the respective electrodes of panel 10 in the first exemplary embodiment.

In the first exemplary embodiment, the value of voltage Vers is set to sustain pulse voltage Vs+3 (V), e.g. approximately 213 (V). Preferably, the value of voltage Vers is set in the voltage range of sustain pulse voltage Vs−10 (V) to sustain pulse voltage Vs+10 (V). When the value of voltage Vers is set higher than the upper limit, the wall voltage is excessively adjusted. When the value is set lower than the lower limit, insufficient adjustment of the wall voltage can destabilize the succeeding address operation.

In the first exemplary embodiment, the gradient of the erasing ramp waveform voltage is set to approximately 10 V/μsec. Preferably, this gradient is set in the range of 2 V/μsec to 20 V/μsec. When this gradient is steeper than the upper limit, discharge for adjusting the wall voltage is not weak. When this gradient is gentler than the lower limit, the discharge can be too weak to adjust the wall charge properly.

Figure 4:
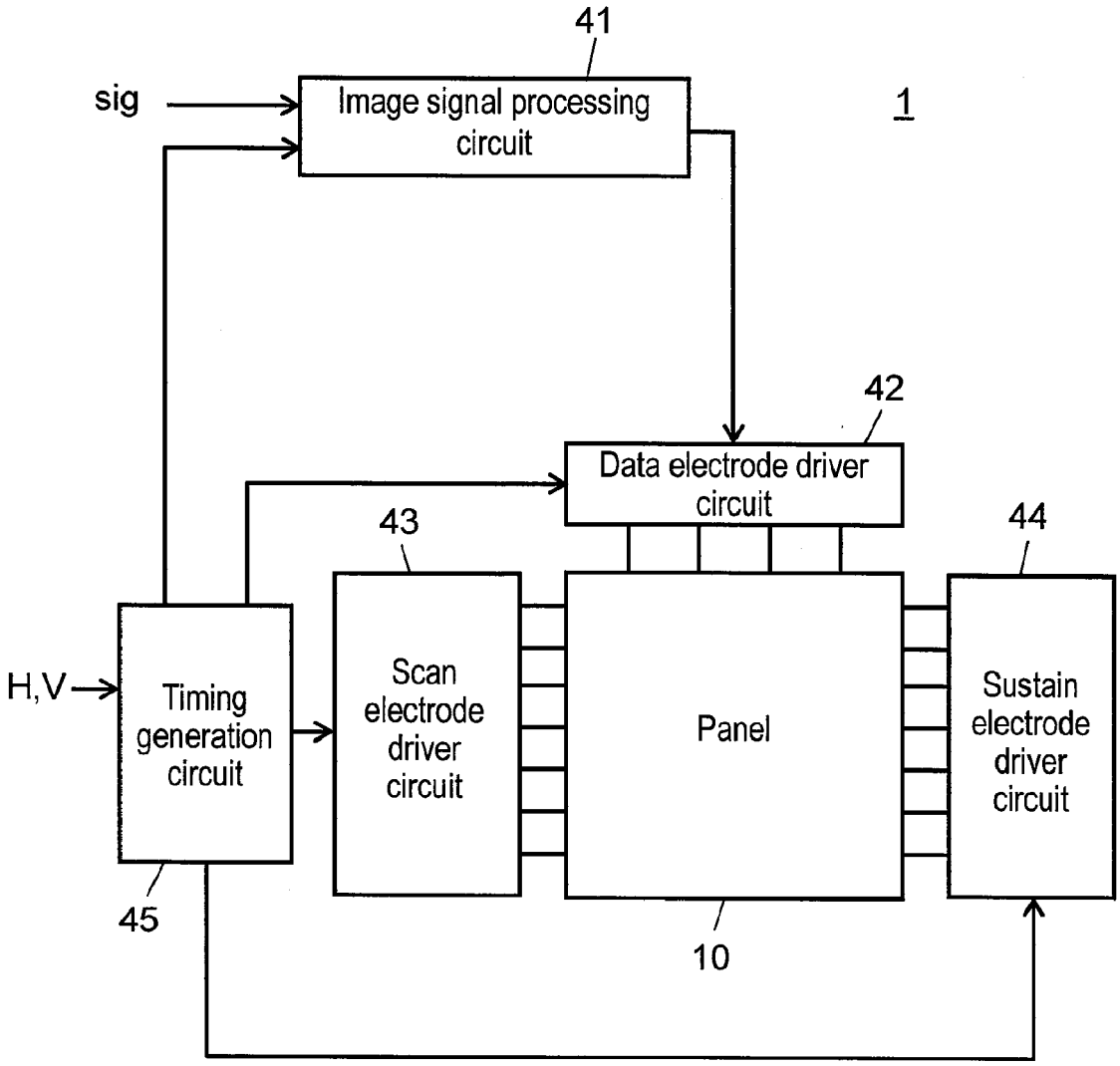
FIG. 4 is a circuit block diagram of a plasma display device in accordance with the first exemplary embodiment of the present invention.

Next, a description is provided of the structure of a plasma display device in accordance with the first exemplary embodiment. FIG. 4 is a circuit block diagram of the plasma display device in accordance with the first exemplary embodiment of the present invention. Plasma display device 1 includes panel 10, image signal processing circuit 41, data electrode driver circuit 42, scan electrode driver circuit 43, sustain electrode driver circuit 44, timing generation circuit 45, and power supply circuits (not shown) for supplying necessary power to the respective circuit blocks.

Image signal processing circuit 41 converts supplied image signal sig into image data showing whether the discharge cells are to be lit or not for each subfield. Data electrode driver circuit 42 converts the image data for each subfield into signals corresponding to respective data electrodes D1 to Dm, and drives respective data electrodes D1 to Dm.

Timing generation circuit 45 generates various types of timing signal for controlling the operation of the respective circuit blocks according to horizontal synchronizing signal H and vertical synchronizing signal V, and supplies the timing signals to the respective circuit blocks. As described above, in the first exemplary embodiment, at the end of each sustain period, an erasing ramp waveform voltage is generated. The timing signals corresponding to the erasing ramp waveform voltage are supplied to scan electrode driver circuit 43 and sustain electrode driver circuit 44. This structure can stabilize initializing discharge and address operation.

Scan electrode driver circuit 43 includes an initializing waveform generation circuit (not shown) for generating an initializing waveform voltage to be applied to scan electrodes SC1 to SCn in each initializing period, a sustain pulse generation circuit (not shown) for generating a sustain pulse to be applied to scan electrodes SC1 to SCn in each sustain period, and a scan pulse generation circuit (not shown) for generating a scan pulse voltage to be applied to scan electrodes SC1 to SCn in each address period. The scan electrode driver circuit drives respective scan electrodes SC1 to SCn according to the timing signals. Sustain electrode driver circuit 44 includes a sustain pulse generation circuit (not shown) and a circuit for generating voltage Ve1 and voltage Ve2, and drives sustain electrodes SU1 to SUn according to the timing signals.

Figure 5:
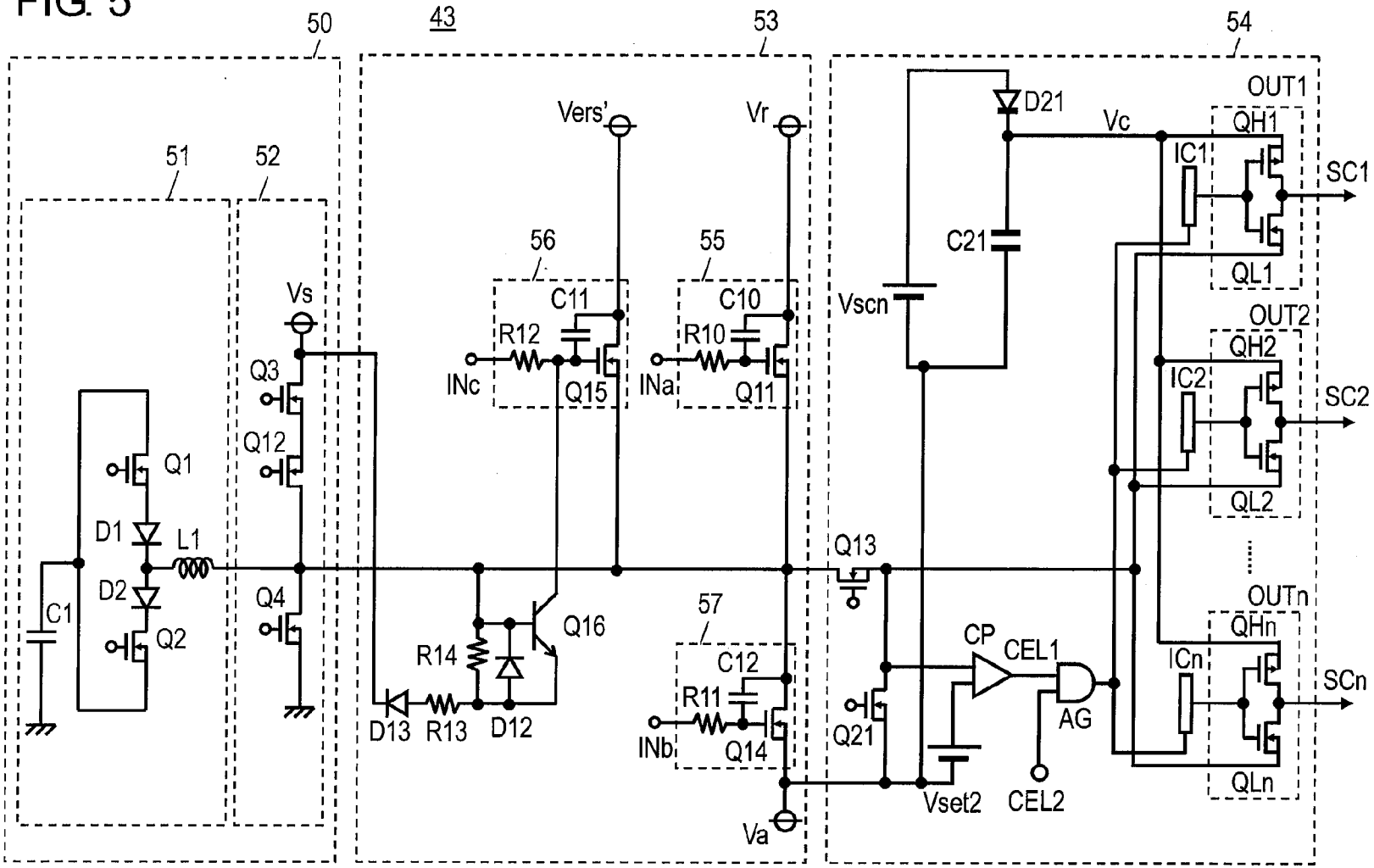
FIG. 5 is a circuit diagram of a scan electrode driver circuit in accordance with the first exemplary embodiment of the present invention.

Next, a description is provided of scan electrode driver circuit 43. FIG. 5 is a circuit diagram of scan electrode driver circuit 43 in accordance with the first exemplary embodiment of the present invention. Scan electrode driver circuit 43 includes sustain pulse generation circuit 50 for generating a sustain pulse, initializing waveform generation circuit 53 for generating an initializing waveform, and scan pulse generation circuit 54 for generating a scan pulse. FIG. 5 shows a separator circuit using switching element Q12, and a separator circuit using switching element Q13. In the following descriptions, the operation of bringing a switching element into conduction is indicated as "turning on", and the operation of bringing out of conduction is indicated as "turning off". The signal for turning on a switching element is indicated as "Hi", and the signal for turning off is indicated as "Lo".

Sustain pulse generation circuit 50 includes power recovery circuit 51 and clamp circuit 52. Power recovery circuit 51 includes power recovery capacitor C1, switching element Q1, switching element Q2, blocking diode D1, blocking diode D2, and resonance inductor L1. Power recovery capacitor C1 has a capacitance sufficiently larger than interelectrode capacitance Cp and is charged to approximately Vs/2, i.e. a half of voltage Vs, to work as a power supply for power recovery circuit 51. Clamp circuit 52 includes switching element Q3 for clamping scan electrodes SC1 to SCn to voltage Vs, and switching element Q4 for clamping scan electrodes SC1 to SCn to 0 (V). Then, the sustain pulse generation circuit generates sustain pulse voltage Vs by switching the respective switching elements according to the timing signals supplied from timing generation circuit 45.

In sustain pulse generation circuit 50, when a sustain pulse waveform is caused to rise, for example, switching element Q1 is turned on to produce resonance between interelectrode capacitance Cp and inductor L1 and power is supplied from power recovery capacitor C1 to scan electrodes SC1 to SCn through switching element Q1, diode D1, and inductor L1. At a point when the voltage of scan electrodes SC1 to SCn approaches to voltage Vs, switching element Q3 is turned on and scan electrodes SC1 to SCn are clamped to voltage Vs. A MOSFET has a parasitic diode called a body diode that is produced in anti-parallel with the portion performing switching operation (that is in parallel with the portion performing switching operation and has a forward-bias direction in the direction opposite to the direction in which current is caused to flow by the switching operation). Thus, even when switching element Q12 is turned off, turning on switching element Q3 allows scan electrodes SC1 to SCn to be clamped to voltage Vs via this body diode.

In contrast, when a sustain pulse waveform is caused to fall, switching element Q2 is turned on to produce resonance between interelectrode capacitance Cp and inductor L1 and power is recovered from interelectrode capacitance Cp to power recovery capacitor C1 through inductor L1, diode D2, and switching element Q2. At a point when the voltage of scan electrodes SC1 to SCn approaches to 0 (V), switching element Q4 is turned on and scan electrodes SC1 to SCn are clamped to 0 (V).

In the first exemplary embodiment, a ramp waveform generation circuit for generating an erasing ramp waveform voltage is provided separately from a ramp waveform generation circuit for generating a rising ramp waveform voltage in the initializing operation. Specifically, initializing waveform generation circuit 53 includes first Miller integrator circuit 55, second Miller integrator circuit 56, and third Miller integrator circuit 57. First Miller integrator circuit 55 is a first ramp waveform generation circuit that includes switching element Q11, capacitor C10, and resistor R10, and generates a rising ramp waveform voltage gently rising to voltage Vi2 in a ramp form. Second Miller integrator circuit 56 is a second ramp waveform generation circuit that includes switching element Q15, capacitor C11, and resistor R12, and generates an erasing ramp waveform voltage gently rising to voltage Vers in a ramp form. Third Miller integrator circuit 57 is a third ramp waveform generation circuit that includes switching element Q14, capacitor C12, and resistor R11, and generates a falling ramp waveform voltage gently deceasing to voltage Vi4 in a ramp form. In FIG. 5, the input terminals of these Millar integrator circuits are shown as input terminal INa, input terminal INb, and input terminal INc.

In order to stop an rise in the voltage in generation of the erasing ramp waveform voltage precisely at voltage Vers, the first exemplary embodiment includes a switching circuit that compares the erasing ramp waveform voltage with a predetermined voltage, and stops the operation of the second Miller integrator circuit for generating the erasing ramp waveform voltage, immediately after the erasing ramp waveform voltage reaches the predetermined voltage. Specifically, the switching circuit includes blocking diode D13, resistor R13 for adjusting the value of voltage Vers, switching element Q16 for making input terminal INc of second Miller integrator circuit 56 in the "Lo" state when the voltage supplied from initializing waveform generation circuit 53 reaches voltage Vers, protective diode D12, and resistor R14.

Switching element Q16 is designed with a generally used NPN transistor. The base thereof is connected to the output of initializing waveform generation circuit 53, the collector thereof is connected to input terminal INc of second Miller integrator circuit 56, and the emitter thereof is connected to voltage Vs via series-connected resistor R13 and diode D13. The resistance of resistor R13 is set so that when the voltage supplied from initializing waveform generation circuit 53 reaches voltage Vers, switching element Q16 is turned on. Thus, when the voltage supplied from initializing waveform generation circuit 53 reaches voltage Vers, switching element Q16 is turned on. Then, because the current to be fed into input terminal INc to operate second Miller integrator circuit 56 is extracted by switching element Q16, the operation of second Miller integrator circuit 56 is stopped.

In general, the gradient of the ramp waveform that a Miller integrator circuit generates is susceptible to variations in the elements constituting the Miller integrator circuit. For this reason, when a waveform is generated only in the operation period of a Miller integrator circuit, the maximum voltage of the ramp waveform is likely to have variations. On the other hand, in the first exemplary embodiment, it is confirmed that setting the maximum voltage of the erasing ramp waveform voltage within ±3 (V) of the target voltage is preferable. With the structure of the first exemplary embodiment, the maximum voltage can be set within approximately ±1 (V) of the target voltage, and the erasing ramp waveform voltage can be generated with high precision.

Preferably, voltage Vers' is a value set higher than voltage Vers. In the first exemplary embodiment, voltage Vers' is set to voltage Vs+30 (V). In the first exemplary embodiment, the resistance of resistor R13 is set so that voltage Vers is equal to voltage Vs+3 (V). Specifically, resistor R13 is set to 100Ω, voltage Vs to 210 (V), and resistor R14 to 1 kΩ. However, these values are set simply according to a 42-inch diagonal panel having 1,080 display electrode pairs, and can be set optimum for the characteristics of the panel and the specifications of the plasma display device.

Initializing waveform generation circuit 53 generates the above initializing waveform voltage or erasing ramp waveform voltage according to the timing signals supplied from timing generation circuit 45.

For example, when the rising ramp waveform voltage in the initializing waveform is generated, a constant current at a predetermined voltage (e.g. 15 (V)) is fed into input terminal INa, thus making input terminal INa in the "Hi" state. Then, constant current flows from resistor R10 toward capacitor C10, the source voltage of switching element Q11 rises in a ramp form, and the output voltage of scan electrode driver circuit 43 also begins to rise in a ramp form.

When the falling ramp waveform voltage in the initializing waveform is generated in the all-cell initializing operation and the selective initializing operation, a constant current at a predetermined voltage (e.g. 15 (V)) is fed into input terminal INb, thus making input terminal INb in the "Hi" state. Then, constant current flows from resistor R11 toward capacitor C12, the drain voltage of switching element Q14 falls in a ramp form, and the output voltage of scan electrode driver circuit 43 also begins to fall in a ramp form.

When the erasing ramp waveform voltage is generated at the end of each sustain period, a constant current at a predetermined voltage is fed into input terminal INc, thus making input terminal INc in the "Hi" state. Thus, constant current flows from resistor R12 toward capacitor C11, the source voltage of switching element Q15 rises in a ramp form, and the output voltage of scan electrode driver circuit 43 also begins to rise in a ramp form. In the first exemplary embodiment, the resistance of resistor R12 is set smaller than the resistance of resistor R10. With this setting, the erasing ramp waveform voltage, i.e. the second ramp waveform voltage, has a gradient steeper than that of the rising ramp waveform voltage, i.e. the first ramp waveform voltage.

When the drive voltage waveform supplied from initializing waveform generation circuit 53 gradually rises and exceeds voltage Vers, switching element Q16 is turned on. Then, the constant current fed into input terminal INc is extracted by switching element 16, and thus the operation of second Miller integrator circuit 56 is stopped. Thereby, the drive voltage waveform supplied from initializing waveform generation circuit 53 is immediately dropped to a base potential of 0 (V). In the first exemplary embodiment, immediately after an rise in the voltage in generation of the erasing ramp waveform voltage is stopped precisely at a predetermined voltage of Vers, the voltage is dropped to a base potential of 0 (V).

Scan pulse generation circuit 54 includes switch circuits OUT1 to OUTn, switching element Q21, control circuits IC1 to ICn, diode D21, and capacitor C21. Switch circuits OUT1 to OUTn output a scan pulse voltage to scan electrodes SC1 to SCn, respectively. Switching element Q21 clamps the low voltage sides of switch circuits OUT1 to OUTn to voltage Va. Control circuits IC1 to ICn control switch circuits OUT1 to OUTn, respectively. Diode D21 and capacitor C21 are used to apply voltage Vc, i.e. a resultant voltage of voltage Va and voltage Vscn superimposed thereon, to the high voltage sides of switch circuits OUT1 to OUTn. Switch circuits OUT1 to OUTn include switching elements QH1 to QHn for outputting voltage Vc, and switching elements QL1 to QLn for outputting voltage Va, respectively. Then, according to the timing signals supplied from timing generation circuit 45, switch circuits OUT1 to OUTn sequentially generate scan pulse voltage Va to be applied to scan electrodes SC1 to SCn, respectively, in each address period. Scan pulse generation circuit 54 outputs the voltage waveform in initializing waveform generation circuit 53 in each initializing period, and the waveform in sustain pulse generation circuit 50 in each sustain period without any change.

Because switching element Q3, switching element Q4, switching element Q12, and switching element Q13 carry an extremely large current, a plurality of FETs, IGBTs, or the like are parallel-connected to reduce the impedance thereof.

Further, scan pulse generation circuit 54 includes AND gate AG for performing AND operation, and comparator CP for comparing the values of input signals fed into two input terminals. Comparator CP compares a resultant voltage of voltage Va and voltage Vset2 superimposed thereon, i.e. voltage (Va+Vset2), with the drive voltage waveform. When the drive voltage waveform is higher than voltage (Va+Vset2), comparator CP outputs "0". Otherwise, comparator CP outputs "1". Fed into AND gate AG are two input signals, i.e. output signal CELL from comparator CP and switching signal CEL2. For example, a timing signal supplied from timing generation circuit 45 can be used as switching signal CEL2. AND gate AG outputs "1" when both input signals are "1". Otherwise, AND gate AG outputs "0". The output of AND gate AG is fed into control circuits IC1 to ICn. When the output of AND gate AG is "0", the scan pulse generation circuit outputs the drive voltage waveform via switching elements QL1 to QLn. When the output of AND gate AG is "1", the scan pulse generation circuit outputs voltage Vc, i.e. the resultant voltage of voltage Va and voltage Vscn superimposed thereon, via switching elements QH1 to QHn.

In the first exemplary embodiment, an FET-based Miller integrator circuit that is practical and has a relatively simple structure is used for the first ramp waveform generation circuit, the second ramp waveform generation circuit, and the third ramp waveform generation circuit. However, the ramp waveform generation circuits are not limited to the above structure. Any circuit may be used as long as the circuit is capable of generating a rising ramp waveform voltage and a falling ramp waveform voltage.

Figure 6:
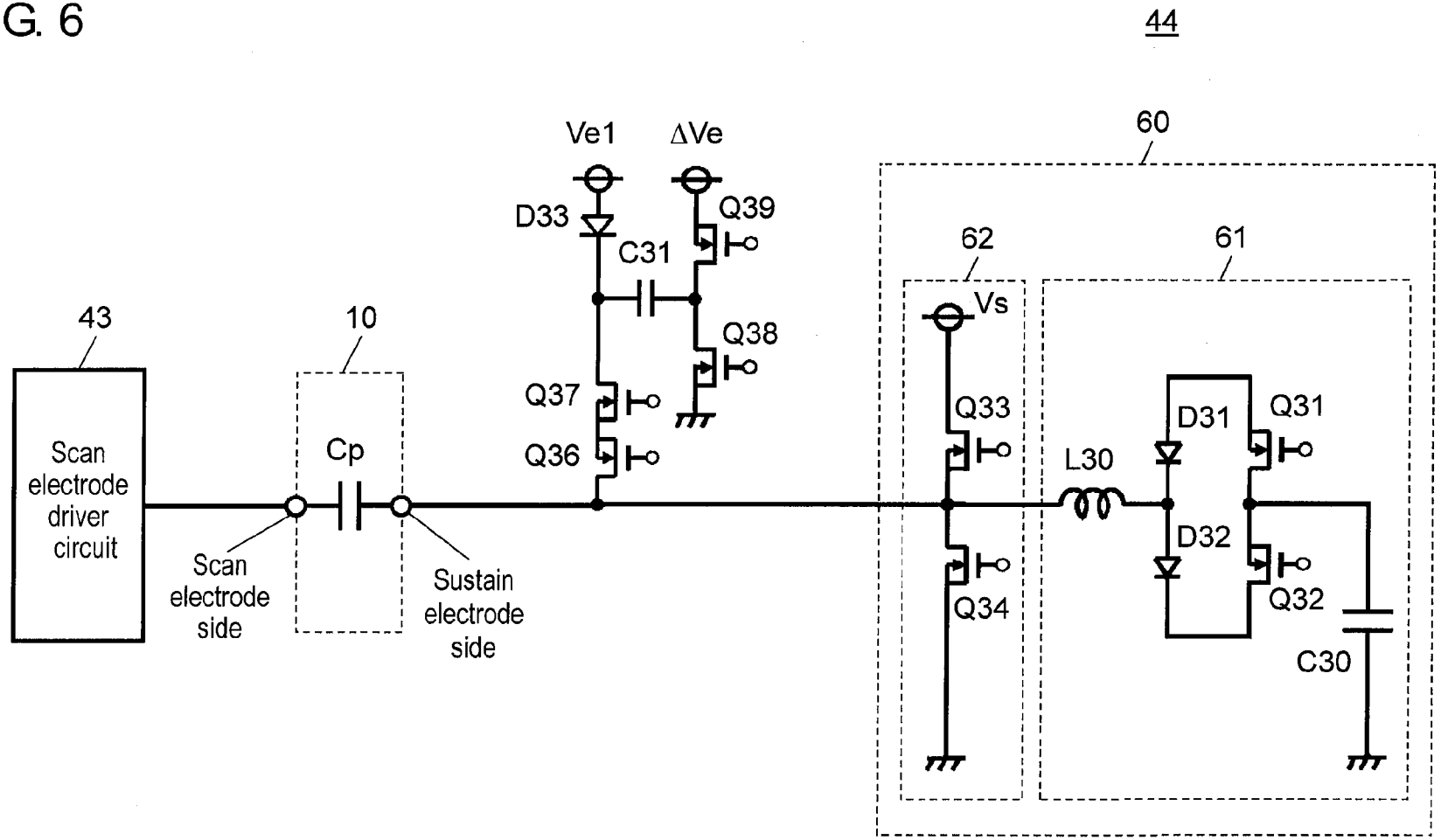
FIG. 6 is a circuit diagram of a sustain electrode driver circuit in accordance with the first exemplary embodiment of the present invention.

Next, a description is provided of sustain electrode driver circuit 44. FIG. 6 is a circuit diagram of sustain electrode driver circuit 44 in accordance with the first exemplary embodiment of the present invention. In FIG. 6, the interelectrode capacitance of panel 10 is indicated as Cp.

Sustain pulse generation circuit 60 of sustain electrode driver circuit 44 is substantially similar in structure to scan pulse generation circuit 50 of scan electrode driver circuit 43. Sustain pulse generation circuit 60 includes the following elements: power recovery circuit 61 for recovering and reusing the power for driving sustain electrodes SU1 to SUn; and clamp circuit 62 for clamping sustain electrodes SU1 to SUn to voltage Vs and 0 (V). The sustain pulse generation circuit is connected to sustain electrodes SU1 to SUn, which is one of the ends of interelectrode capacitance Cp of panel 10.

Power recovery circuit 61 includes power recovery capacitor C30, switching element Q31, switching element Q32, blocking diode D31, blocking diode D32, and resonance inductor L30. Power recovery circuit 61 causes a sustain pulse to rise and fall by producing LC resonance between interelectrode capacitance Cp and inductor L30. Clamp circuit 62 includes switching element Q33 for clamping sustain electrodes SU1 to SUn to voltage Vs, and switching element Q34 for clamping sustain electrodes SU1 to SUn to 0 (V). Sustain electrodes SU1 to SUn are connected to power supply VS and clamped to voltage Vs via switching element Q33. Sustain electrodes SU1 to SUn are grounded and clamped to 0 (V) via switching element Q34.

Sustain electrode driver circuit 44 includes power supply VE1 for generating voltage Ve1, switching element Q36, switching element Q37, power supply ΔVE for generating voltage ΔVe, blocking diode D33, capacitor C31, switching element Q38, and switching element Q39. Switching element Q36 and switching element Q37 apply voltage Ve1 to sustain electrodes SU1 to SUn. Capacitor C31 is a pumping-up capacitor for adding voltage ΔVe onto voltage Ve1. Switching element Q38 and switching element Q39 are used to add voltage ΔVe onto voltage Ve1 and provide voltage Ve2.

For example, at the timing of application of voltage Ve1 as shown in FIG. 3, sustain electrode driver circuit 44 brings switching element Q36 and switching element Q37 into conduction, and applies positive voltage Ve1 to sustain electrodes SU1 to SUn via diode D33, switching element Q36, and switching element Q37. At this time, switching element Q38 is brought into conduction and capacitor C31 is charged to voltage Ve1. At the timing of application of voltage Ve2 as shown in FIG. 3, while keeping switching element Q36 and switching element Q37 in conduction, sustain electrode driver circuit 44 brings switching element Q38 out of conduction and switching element Q39 into conduction. Thus, voltage ΔVe is superimposed on the voltage of capacitor C31, and voltage (Ve1+ΔVe), i.e. voltage Ve2, is applied to sustain electrodes SU1 to SUn. At this time, blocking diode D33 works to block the current from capacitor C31 to power supply VE1.

Figure 7:
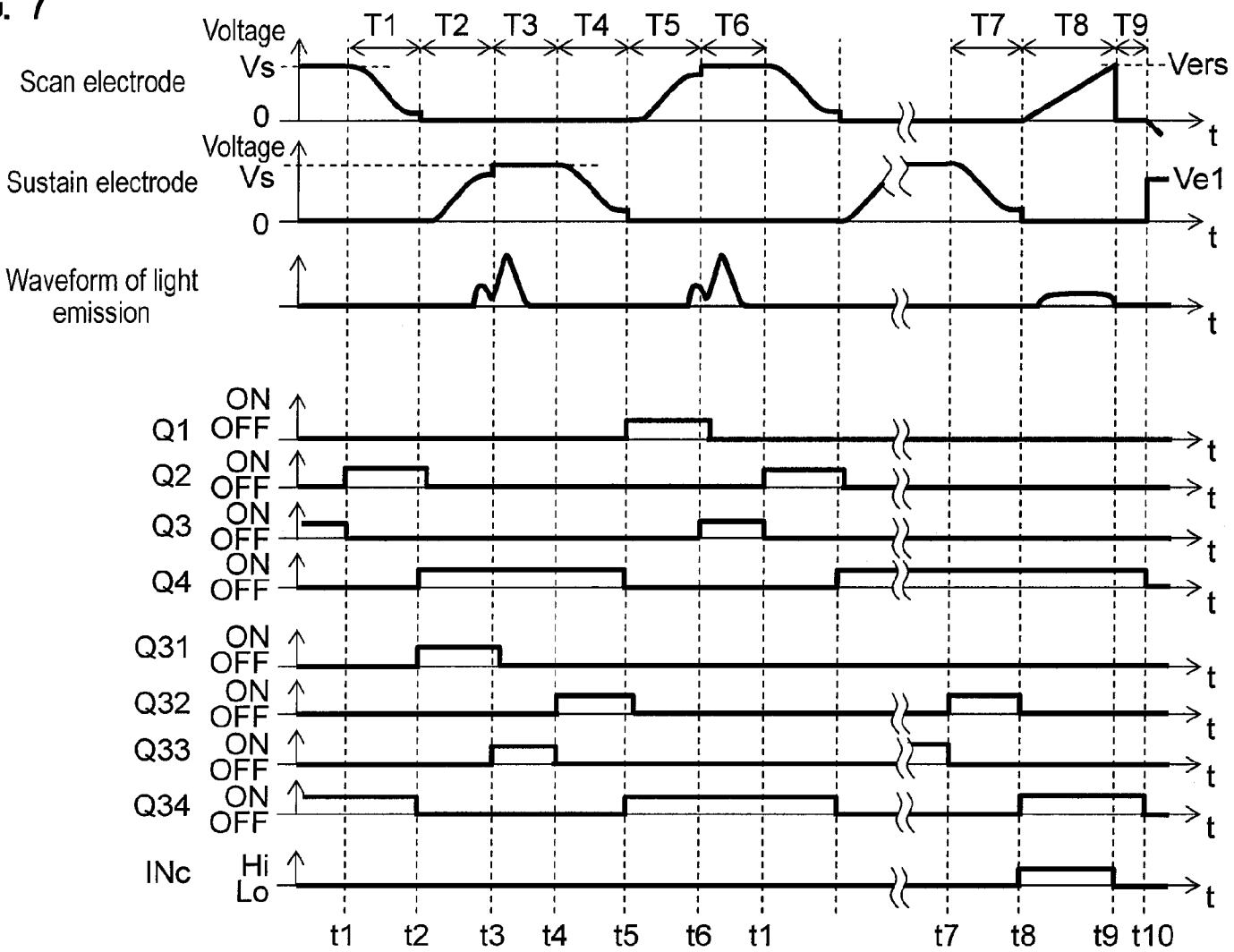
FIG. 7 is a timing chart for explaining an example of the operation of the scan electrode driver circuit and the sustain electrode driver circuit in accordance with the first exemplary embodiment of the present invention.

Next, a detailed description is provided of the drive voltage waveforms in each sustain period. FIG. 7 is a timing chart for explaining an example of the operation of scan electrode driver circuit 43 and sustain electrode driver circuit 44 in accordance with the first exemplary embodiment of the present invention. FIG. 7 is a detailed timing chart of the portion surrounded by the broken lines in FIG. 3. First, one periodic cycle of a sustain pulse is divided into six sub-periods shown by T1 to T6, and a description is provided of each sub-period. This periodic cycle refers to the interval of a sustain pulse to be repeatedly applied to display electrode pairs in each sustain period, e.g. a cycle repeated by sub-periods T1 to T6. In FIG. 7, positive waveforms are shown for explanation. However, the present invention is not limited to these waveforms. Although exemplary embodiments in negative waveforms are omitted, the same advantages can be offered in the negative waveforms. In the negative waveforms, "rising" and "falling" in the positive waveforms in the following descriptions are read as "falling" and "rising", respectively. In the chart, the signal for turning on the switching elements is indicated as "ON", and the signal for turning off as "OFF".

(Sub-period T1)

At time t1, switching element Q2 is turned on. Then, the electric charge on the side of scan electrodes SC1 to SCn begins to flow toward capacitor C1 through inductor L1, diode D2, and switching element Q2, and thus the voltage of scan electrodes SC1 to SCn begins to fall. Because inductor L1 and interelectrode capacitance Cp forms a resonance circuit, at time t2 after a half of the resonance period has elapsed, the voltage of scan electrodes SC1 to SCn falls substantially to 0 (V). However, the power loss due to resistance components of the resonance circuit or the like hinders the voltage of scan electrodes SC1 to SCn from reaching 0 (V). During this period, switching element Q34 is kept ON.

(Sub-period T2)

At time t2, switching element Q4 is turned on. Then, scan electrodes SC1 to SCn are directly grounded via switching element Q4. Thus, the voltage of scan electrodes SC1 to SCn is forced to fall to 0 (V).

Further, at time t2, switching element Q31 is turned on. Then, current begins to flow from power recovery capacitor C30 through switching element Q31, diode D31, and inductor L30, and thus the voltage of sustain electrodes SU1 to SUn begins to rise. Because inductor L30 and interelectrode capacitance Cp forms a resonance circuit, at time t3 after a half of the resonance period has elapsed, the voltage of sustain electrodes SU1 to SUn rises substantially to voltage Vs. However, the power loss due to resistance components of the resonance circuit or the like hinders the voltage of sustain electrodes SU1 to SUn from reaching voltage Vs.

(Sub-Period T3)

At time t3, switching element Q33 is turned on. Then, sustain electrodes SU1 to SUn are directly connected to power supply VS via switching element Q33. Thus, the voltage of sustain electrodes SU1 to SUn is forced to rise to voltage Vs. At this time, in the discharge cells having generated address discharge, the voltage between scan electrode SCi and sustain electrode SUi exceeds the breakdown voltage and causes sustain discharge.

(Sub-periods T4 to T6)

The sustain pulse applied to scan electrodes SC1 to SCn and the sustain pulse applied to sustain electrodes SU1 to SUn have an identical waveform. The operation in sub-period T4 to sub-period T6 is the same as the operation in sub-period T1 to sub-period T3 in which scan electrodes SC1 to SCn are exchanged for sustain electrodes SU1 to SUn. Thus, the descriptions of the operation in these sub-periods are omitted.

It is sufficient that switching element Q2 is turned off after time t2 before time t5. It is sufficient that switching element Q31 is turned off after time t3 before time t4. It is sufficient that switching element Q32 is turned off after time t5 before time t2 in the next cycle. It is sufficient that switching element Q1 is turned off after time t6 before time t1 in the next cycle. In order to lower the output impedance of sustain pulse generation circuits 50 and 60, preferably, switching element Q34 is turned off immediately before time t2, and switching element Q3 is turned off immediately before time t1. Preferably, switching element Q4 is turned off immediately before time t5, and switching element Q33 is turned off immediately before time t4.

In each sustain period, the above operation in sub-periods T1 to T6 is repeated according to the necessary number of pulses. In this manner, a sustain pulse voltage that changes from a base potential of 0 (V) to voltage Vs for causing sustain discharge is applied alternately to each display electrode pair 24 so that the discharge cells generate the sustain discharge.

The resonance period of LC resonance between inductor L1 of power recovery circuit 51 and interelectrode capacitance Cp of panel 10, and the resonance period of LC resonance between inductor L30 of power recovery circuit 61 and interelectrode capacitance Cp of the panel can be obtained with the formula "$2\pi (LCp)^{1/2}$" where the inductance of each of inductor L1 and inductor L30 is L. In the first exemplary embodiment, inductor L1 and inductor L30 are set so that a half of the resonance period in power recovery circuit 51 and power recovery circuit 61, respectively, is approximately 600 nsec. Further, each of the rising periods of the sustain pulses, i.e. sub-period T2 and sub-period T5 in this embodiment, is set slightly shorter than a half of the resonance period or longer. This setting can cause light emission having double peaks (hereinafter referred to as "double-peak light emission") in which a first relatively weak discharge occurs and thereafter a second strong discharge occurs. In the first exemplary embodiment, a sustain pulse for causing light emission having a single peak (hereinafter "single-peak light emission") and a sustain pulse for causing double-peak light emission are generated and switched. Each of the rising periods of the sustain pulses for causing single-peak light emission, i.e. sub-period T2 and sub-period T5, is set to approximately 350 nsec. Each of the rising periods of the sustain pulses for causing double-peak light emission is set from approximately 450 nsec to approximately 550 nsec. FIG. 7 shows sustain pulses for causing double-peak light emission as an example.

Next, a description is provided of the operation when the erasing ramp waveform voltage is generated at the end of each sustain period.

(Sub-period T7)

This sub-period is a falling period of a sustain pulse applied to sustain electrodes SU1 to SUn, and is similar to sub-period T4. In other words, switching element Q33 is turned off immediately before time t7, and switching element Q32 is turned on at time t7. With this operation, the electric charge on the side of sustain electrodes SU1 to SUn begins to flow toward capacitor C30 through inductor L30, diode D32, and switching element Q32, and thus the voltage of sustain electrodes SU1 to SUn begins to fall. While switching element Q4 is kept ON, scan electrodes SC1 to SCn are kept at a base potential of 0 (V).

(Sub-period T8)

At time t8, switching element Q34 is turned on, and the voltage of sustain electrodes SU1 to SUn is forced to drop to 0 (V).

Further, at time t8, input terminal INc is set to the "Hi" state. Thus, constant current flows from resistor R12 toward capacitor C11, the source voltage of switching element Q15 rises in a ramp form, the output voltage of scan electrode driver circuit 43 begins to rise in a ramp form at a gradient steeper than that of the rising ramp waveform voltage. In this manner, the erasing ramp waveform voltage, i.e. the second ramp waveform voltage, rising from a base potential of 0 (V) toward voltage Vers is generated. While this erasing ramp waveform voltage is rising, the voltage difference between scan electrode SCi and sustain electrode SUi exceeds the breakdown voltage. At this time, in the first exemplary embodiment, each value is set so that discharge occurs only between scan electrode SCi and sustain electrode SUi. For example, sustain pulse voltage Vs is set to approximately 210 (V), voltage Vers to approximately 213 (V), and the gradient of the erasing ramp waveform voltage to approximately 10 V/μsec. With these settings, weak discharge can be generated between scan electrode SCi and sustain electrode SUi. The weak discharge can be continued while the erasing ramp waveform voltage is rising.

At this time, if an instantaneous strong discharge is caused by a rapid change in voltage, a large amount of charged particles generated by the strong discharge form large wall charge to alleviate the rapid voltage change, and thus excessively erase the wall voltage formed by the preceding sustain discharge. In a panel having an increased screen size, definition, and driving impedance, waveform distortion, such as ringing, is likely to occur in the drive waveforms generated by the driver circuits. Thus, for the above drive waveforms for generating erasing discharge using a narrow-width pulse, waveform distortion can cause a stronger discharge.

However, in the first exemplary embodiment, the erasing ramp waveform voltage for gradually rising the applied voltage continuously causes weak erasing discharge between scan electrode SCi and sustain electrode SUi. Thus, even in a panel having an increased screen size, definition, and driving impedance, the generation of the erasing discharge can be stabilized, and the wall voltage on scan electrode SCi and sustain electrode SUi can be adjusted to a state optimum for stabilizing the succeeding address operation.

Though not shown in the chart, data electrodes D1 to Dm are kept at 0 (V), and thus positive wall voltage is formed on data electrodes D1 to Dm.

(Sub-period T9)

When the drive voltage waveform supplied from initializing waveform generation circuit 53 reaches voltage Vers at time t9, switching element Q16 is turned on. Thus, the current to be fed into input terminal INc to operate second Miller integrator circuit 56 is extracted by switching element Q16, and the operation of second Miller integrator circuit 56 is stopped.

As described above, when the voltage applied to scan electrodes SC1 to SCn is kept at voltage Vers after the voltage is reached, unusual discharge that induces erroneous discharge in the succeeding address period can occur. However, in the first exemplary embodiment, immediately after the voltage applied to scan electrodes SC1 to SCn has reached voltage Vers, the voltage is dropped to a base potential of 0 (V). This structure can prevent the occurrence of this unusual discharge.

Then, after time t10 in the initializing period of the succeeding subfield, the initializing operation in the succeeding subfield is started. For example, when the succeeding subfield is a selective initializing subfield, the selective initializing operation is started. In other words, a falling ramp waveform voltage is applied to scan electrodes SC1 to SCn, and voltage Ve1 is applied to the sustain electrodes.

Figure 8:
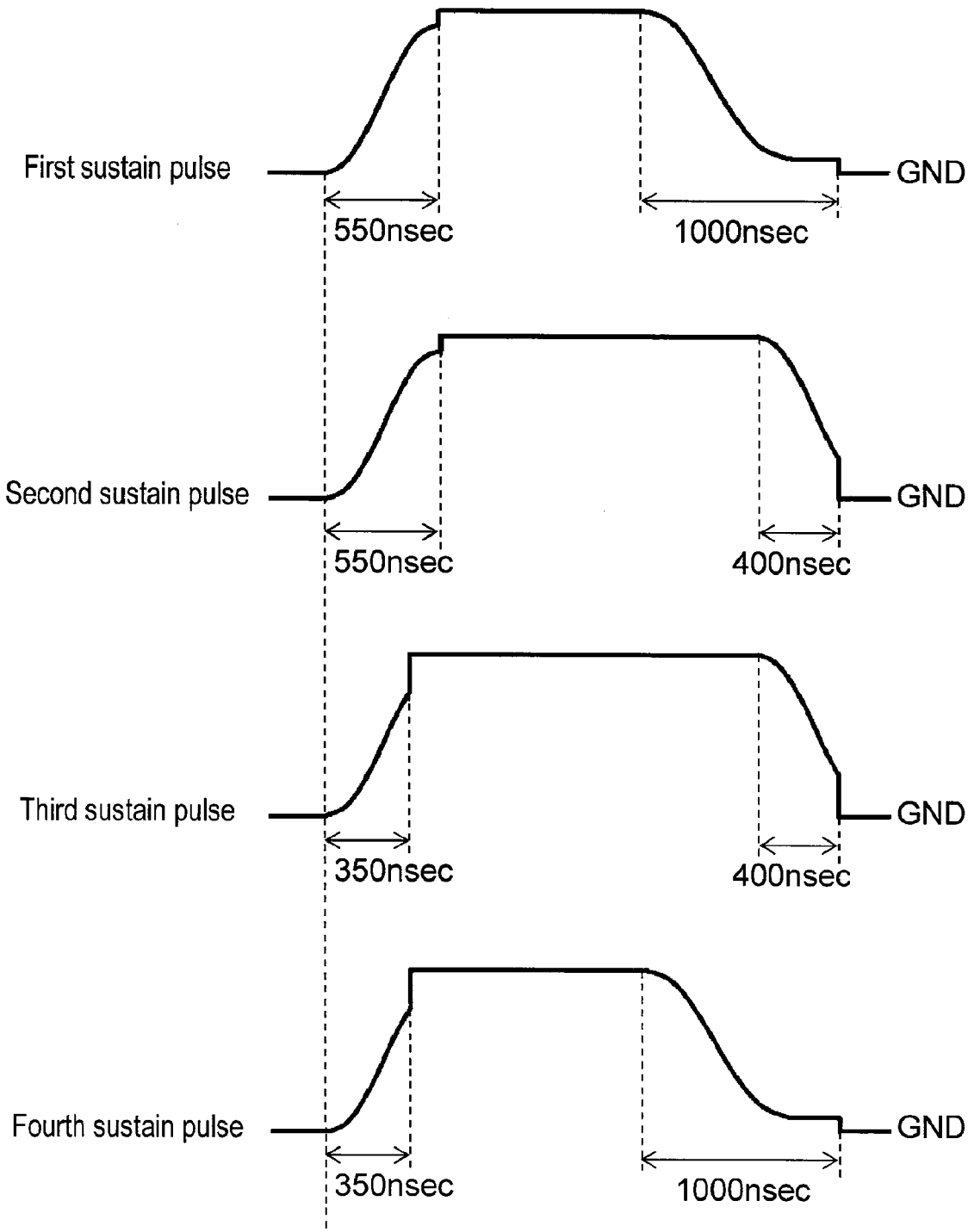
FIG. 8 is a waveform chart schematically showing sustain pulse waveforms in accordance with the first exemplary embodiment of the present invention.

Next, a detailed description is provided of drive voltage waveforms in each sustain period. FIG. 8 is a waveform chart schematically showing sustain pulse waveforms in the first exemplary embodiment of the present invention. In the first exemplary embodiment, four types of sustain pulse having different waveform shapes are generated and switched. Actually, the waveform shape of each sustain pulse is changed by controlling the timing of switching each switching element in sustain pulse generation circuit 50 and sustain pulse generation circuit 60 and controlling the time for driving each power recovery circuit and each voltage clamp circuit. In FIG. 8, the ground potential is indicated as "GND".

As shown in FIG. 8, in this exemplary embodiment, the following four types of sustain pulse having different waveform shapes are generated and periodically switched. The pulses are as follows: a first sustain pulse, which is to be a reference pulse; a second sustain pulse having a falling edge steeper than that of the first sustain pulse; a third sustain pulse having a rising edge and a falling edge steeper than those of the first sustain pulse; and a fourth sustain pulse having a rising edge steeper than that of the first sustain pulse.

Specifically, for the first sustain pulse, the reference pulse, the time period for rising (rising period) is set to approximately 550 nsec, and the time period for falling (falling period) is set to approximately 1,000 nsec.

For the second sustain pulse, the falling period is set to approximately 400 nsec, which is shorter than that of the first sustain pulse, so that the falling edge is steeper than that of the first sustain pulse. The rising period is set to approximately 550 nsec, which is equal to that of the first sustain pulse.

For the third sustain pulse, the rising period is set to approximately 350 nsec and the falling period is set to approximately 400 nsec so that both rising and falling edges are steeper than those of the first sustain pulse.

For the fourth sustain pulse, the rising period is set to approximately 350 nsec, which is shorter than that of the first sustain pulse, so that the rising edge is steeper than that of the first sustain pulse. The falling period is set to approximately 1,000 nsec, which is equal to that of the first sustain pulse.

The reason why such four types of sustain pulse are generated and switched in the first exemplary embodiment is as follows.

The phenomenon of afterimage occurs because the emission intensity of a discharge cell varies with the previous conditions of light emission in the discharge cell. For example, when the entire screen is lit after a still image is displayed thereon for an extended period of time, the still image displayed is perceived as a afterimage in some cases.

At this time, when the emission intensity of the lit discharge cells is higher than the emission intensity of unlit discharge cells, a positive afterimage is generated. In the reverse case, a negative afterimage is generated. When a still image is displayed for a longer time period, such afterimage tends to be seen more conspicuously.

Some of the causes for the phenomenon of afterimage as described above are still unknown. However, experimental results show that the phenomenon of afterimage can be alleviated and the display luminance of the respective discharge cells can be uniformized by generating a sustain pulse for causing light emission having a single peak, i.e. single-peak light emission, and a sustain pulse for causing light emission having double peaks, i.e. double-peak light emission, periodically switching these pulses in each sustain period, and optimizing the balance of the single-peak light emission and double-peak light emission in the sustain discharge.

Thus, in the first exemplary embodiment, a sustain pulse for causing single-peak light emission and a sustain pulse for causing double-peak light emission are generated and periodically switched in the sustain operation.

Figure 9A:
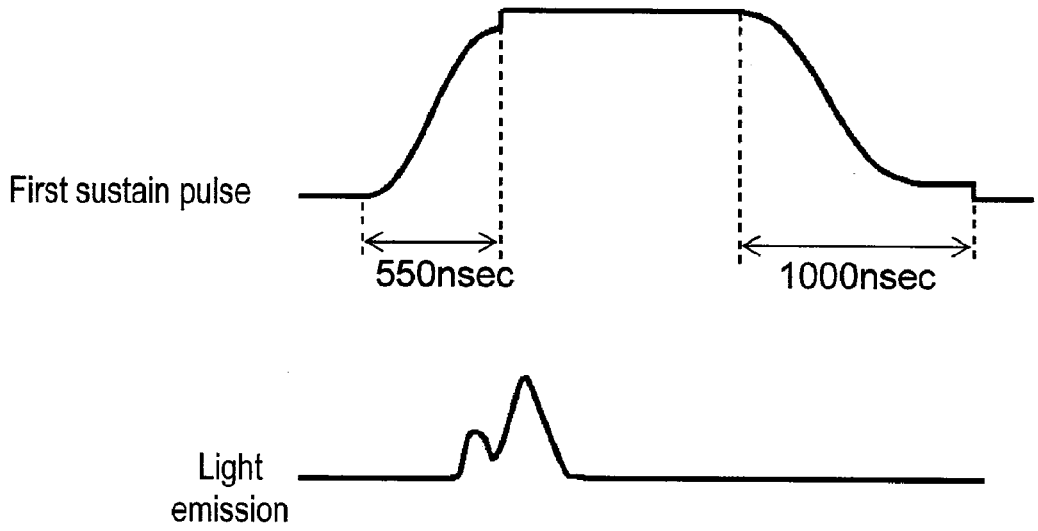
FIG. 9A is a waveform chart schematically showing a sustain pulse for use in the first exemplary embodiment of the present invention and light emission caused by the pulse.
Figure 9B:
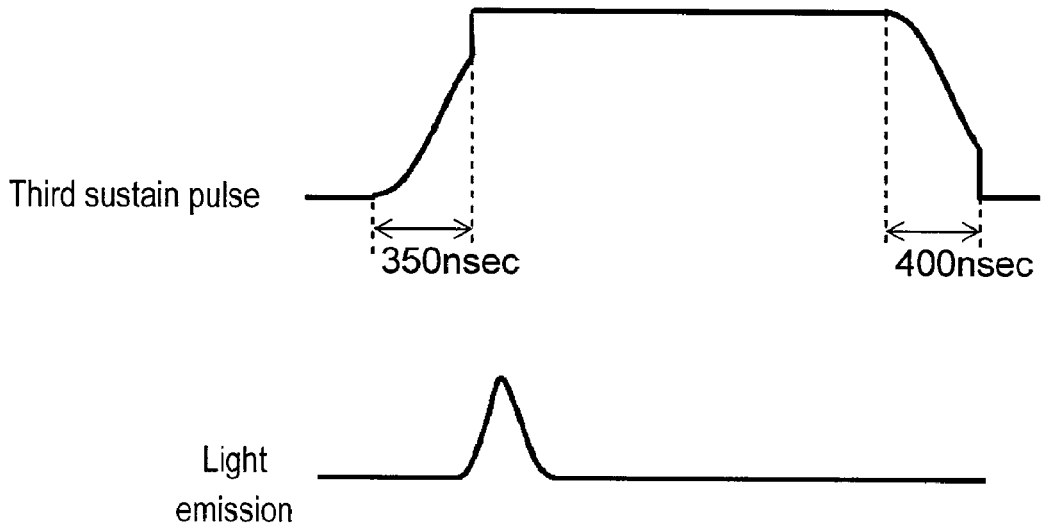
FIG. 9B is a waveform chart schematically showing another sustain pulse for use in the first exemplary embodiment of the present invention and light emission caused by the pulse.

FIG. 9A and FIG. 9B are waveform charts schematically showing sustain pulses for use in the first exemplary embodiment of the present invention and light emission caused by the pulses.

In the first exemplary embodiment, the first sustain pulse and the second sustain pulse are sustain pulses for causing double-peak light emission. As shown in FIG. 9A, the first sustain pulse and the second sustain pulse have a rising period set to approximately 550 nsec to cause double-peak light emission. FIG. 9A shows the first sustain pulse only.

In the first exemplary embodiment, the third sustain pulse and the fourth sustain pulse are sustain pulses for causing single-peak light emission. As shown in FIG. 9B, the third sustain pulse and the fourth sustain pulse have a rising period set to approximately 350 nsec to cause single-peak light emission. FIG. 9B shows the third sustain pulse only.

In the first exemplary embodiment, the pulse width of each of the first to fourth sustain pulses is set to approximately 2.7 μsec.

It is confirmed that a strong discharge generated on the rising edge of a sustain pulse may cause generation of a weak discharge on the falling edge of the sustain pulse in the sustain operation. This weak discharge decreases the wall charge formed by the sustain discharge. Thus, generation of the weak discharge on the falling edge is not preferable because the discharge can destabilize the succeeding sustain discharge.

However, according to experimental results, when single-peak light emission is caused by one strong discharge on the rising edge of a sustain pulse, setting a steeper falling edge in the preceding sustain pulse can prevent the weak discharge from occurring on the falling edge of the sustain pulse. Further, the experimental results also show that such a structure can further stabilize the generation of single-peak light emission.

According to experimental results, the generation of the double-peak light emission can further be stabilized by setting a gentler falling edge in the preceding sustain pulse.

Based on these experimental results, in the first exemplary embodiment, in each of the sustain pulses (i.e. the second sustain pulse and the third sustain pulse in this embodiment) to be generated immediately before a sustain pulse having a steeper rising edge for causing single-peak light emission, the falling edge is set steeper (approximately 400 nsec in this embodiment). In each of the sustain pulses (i.e. the first sustain pulse and the fourth sustain pulse in this embodiment) to be generated immediately before a sustain pulse having a gentler rising edge for causing double-peak light emission, the falling edge is set gentler (approximately 1,000 nsec in this embodiment).

Figure 10:
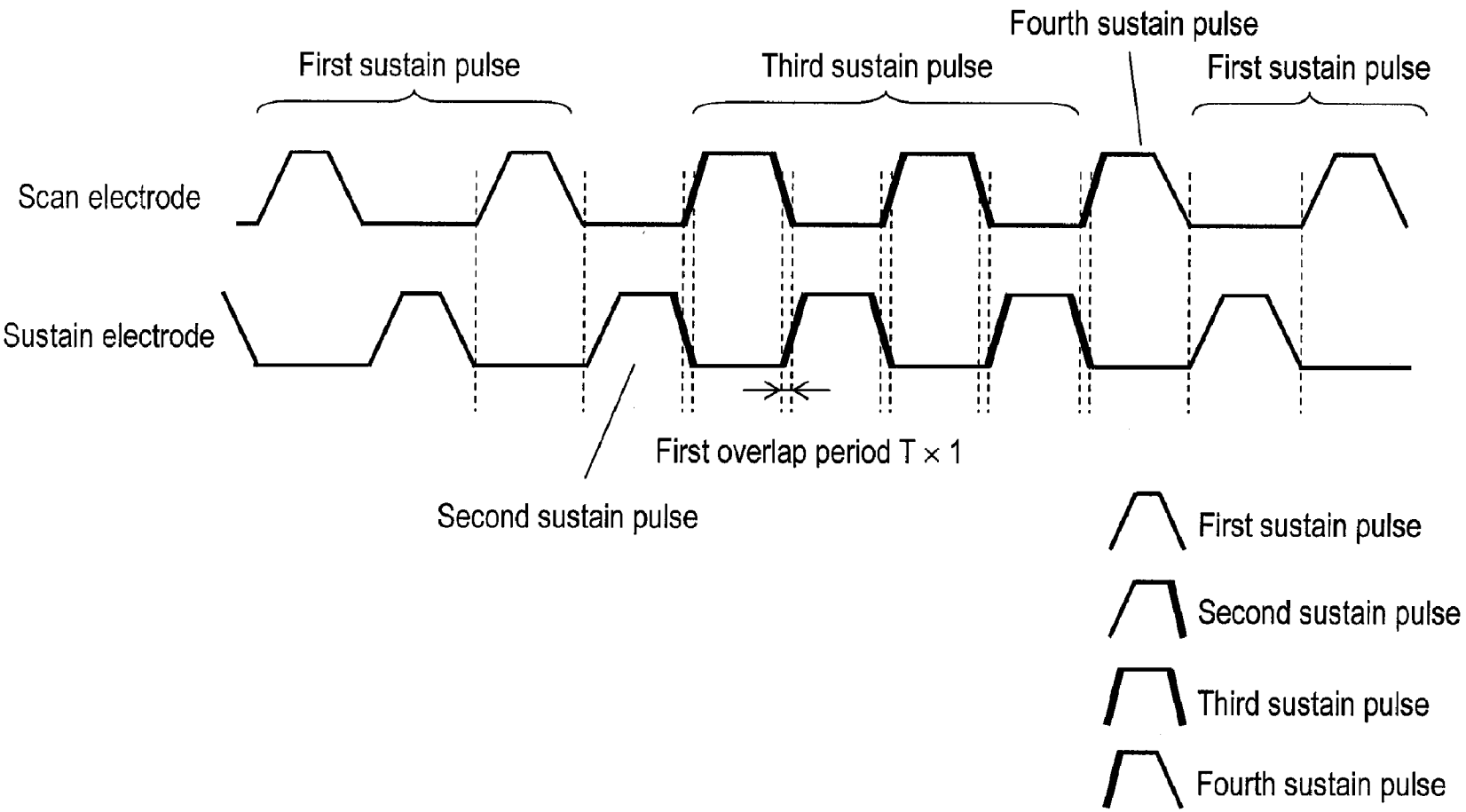
FIG. 10 is a schematic waveform chart showing an example of the sequence of a first sustain pulse, second sustain pulse, third sustain pulse, and fourth sustain pulse in accordance with the first exemplary embodiment of the present invention.

FIG. 10 is a schematic waveform chart showing an example of the sequence of the first sustain pulse, second sustain pulse, third sustain pulse, and fourth sustain pulse in accordance with the first exemplary embodiment. In this example of the sequence, first, the first sustain pulse for causing double-peak light emission is applied alternately to scan electrodes SC1 to SCn and sustain electrodes SU1 to SUn. Thereafter, the second sustain pulse for causing double-peak light emission is applied to sustain electrodes SU1 to SUn. In this sequence, a sustain pulse having a gentler rising edge can be applied immediately after a sustain pulse having a gentler falling edge. Thus, the generation of double-peak light emission can be stabilized.

After the second sustain pulse is applied to sustain electrodes SU1 to SUn, alternate application of the third sustain pulse for causing single-peak light emission to scan electrodes SC1 to SCn and sustain electrodes SU1 to SUn is repeated at a predetermined number of times (four times in this embodiment). Thereafter, the fourth sustain pulse for causing single-peak light emission is applied to scan electrodes SC1 to SCn. In this sequence, a sustain pulse having a steeper rising edge can be applied immediately after a sustain pulse having a steeper falling edge. Thus, a weak discharge on the falling edges can be prevented and the generation of single-peak light emission can be stabilized.

After the fourth sustain pulse is applied to sustain electrodes SU1 to SUn, the first sustain pulse for causing double-peak light emission is applied alternately to scan electrodes SC1 to SCn and sustain electrodes SU1 to SUn. In this sequence, a sustain pulse having a gentler rising edge can be applied immediately after a sustain pulse having a gentler falling edge. Thus, the generation of double-peak light emission can be stabilized.

It is also confirmed that successive application of a sustain pulse having a steeper rising edge at a larger number of times increases the reactive power (power wasted without contributing to light emission). Preferably, the number of times of successive application of a sustain pulse having a steeper rising edge is set within the range in which the above advantage can be offered sufficiently without increasing the reactive power. In the first exemplary embodiment, preferably, the number of times of successive application of a sustain pulse having a steeper rising edge is set in the range of two to ten. In the first exemplary embodiment, a sustain pulse having a steeper rising edge for causing single-peak light emission is generated successively at five times (after successive generation of the third sustain pulse at four times, generation of the fourth sustain pulse once). A sustain pulse having a gentler rising edge for causing double-peak light emission is generated successively at eleven times (after successive generation of the first sustain pulse at ten times, generation of the second sustain pulse once).

In this manner, in the first exemplary embodiment, four types of sustain pulse, i.e. the first sustain pulse, second sustain pulse, third sustain pulse, and fourth sustain pulse, are generated and periodically switched. Further, each of the first sustain pulse and the third sustain pulse is generated successively at a predetermined number of times. The second sustain pulse is generated once immediately before the third sustain pulse. The fourth sustain pulse is generated once immediately after successive generation of the third sustain pulse. This sequence allows generation of sustain pulses so that a sustain pulse having a steeper falling edge is placed immediately before a sustain pulse having a steeper rising edge, and a sustain pulse having a gentler falling edge is placed immediately before a sustain pulse having a gentler rising edge.

On the other hand, when strong discharge is generated in discharge cells, a large current instantaneously flowing through the driver circuits is likely to generate waveform distortion called ringing in the drive waveforms. For example, large ringing generated in a sustain pulse can not only destabilize the sustain discharge but also impose a large load on each element constituting the sustain pulse generation circuit. For this reason, it is preferable to suppress generation of ringing as much as possible.

According to experimental results, ringing can be suppressed by overlapping the time period for causing a sustain pulse having a steeper falling edge to fail with the time period for causing a sustain pulse having a steeper rising edge to rise.

Thus, in the first exemplary embodiment, as shown in FIG. 10, a first overlap period T×1 is provided between the second sustain pulse and the third sustain pulse and between the third sustain pulse and the third sustain pulse so that the time period for causing the corresponding sustain pulse to fall is overlapped with the time period for causing the corresponding sustain pulse to rise.

This structure can suppress ringing in the sustain pulse waveform having a steeper rising edge, reduce the load imposed on each element constituting the sustain pulse generation circuit, and further stabilize the generation of the sustain discharge.

As described above, in the first exemplary embodiment, four types of sustain pulse are generated and periodically switched in the above sequence. Further, a first overlap period T×1 is provided between a sustain pulse having a steeper falling edge and a sustain pulse having a steeper rising edge. This structure can stabilize the generation of single-peak light emission and double-peak light emission in the sustain discharge, alleviate the phenomenon of afterimage, and uniformize the display luminance of the respective discharge cells.

Figure 11:
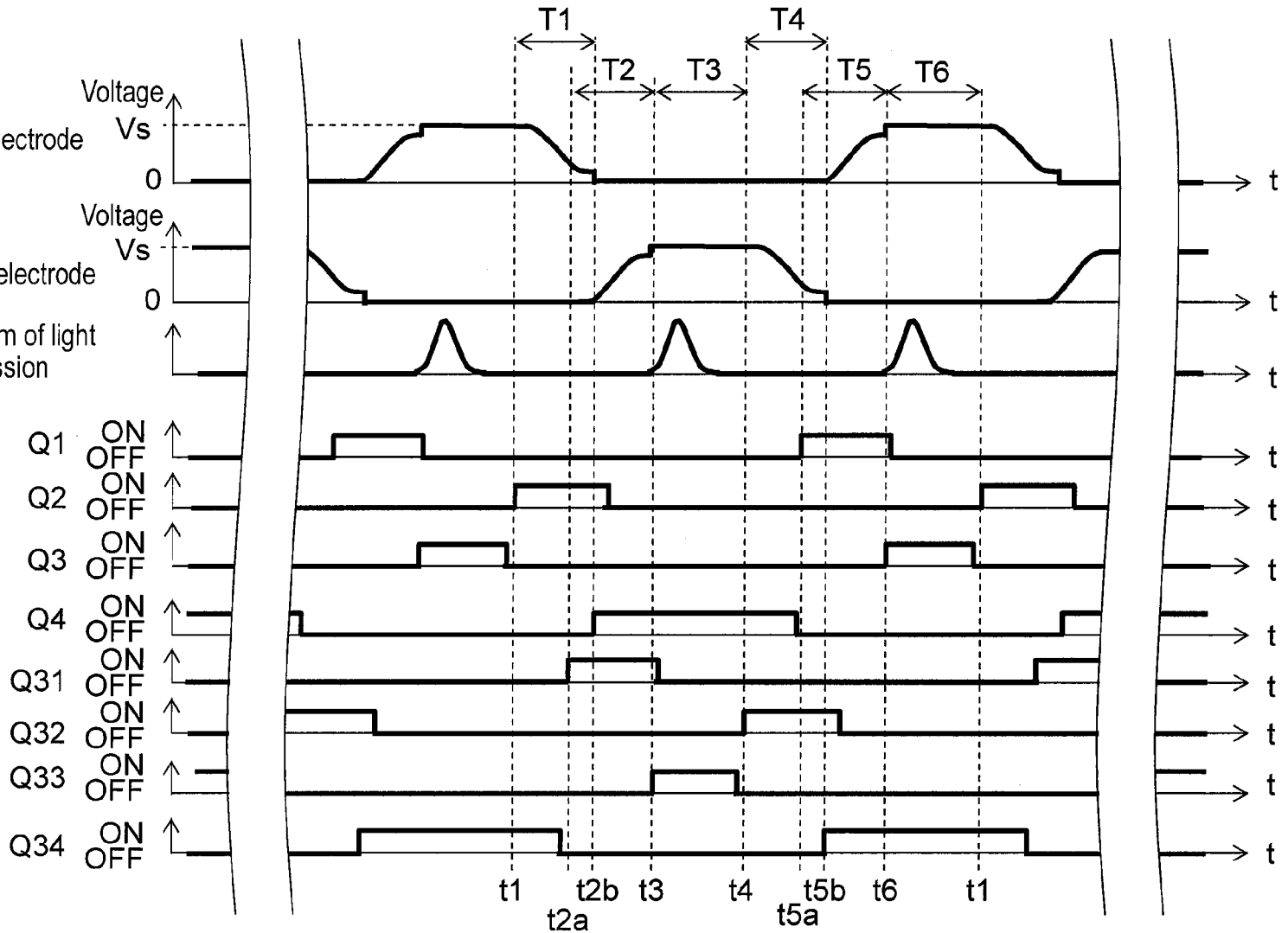
FIG. 11 is a timing chart for explaining another example of the operation of the scan electrode driver circuit and the sustain electrode driver circuit in accordance with the first exemplary embodiment of the present invention.

The first overlap period T×1 can be provided by advancing the timing of causing a sustain pulse to rise. FIG. 11 is a timing chart for explaining another example of the operation of the scan electrode driver circuit and the sustain electrode driver circuit in accordance with the first exemplary embodiment. The switching operations of each switching element in FIG. 11 are similar to those of FIG. 7, and thus only the differences are described herein.

When the first overlap period T×1 is provided, the timing of causing a sustain pulse to rise is advanced. Specifically, as shown in FIG. 11, at time t2*a* before time t2*b* at which the falling edge of the sustain pulse to be applied to scan electrodes SC1 to SCn ends, switching element Q31 for causing the sustain pulse to be applied to sustain electrodes SU1 to SUn to rise is turned on. At time t5*a* before time t5*b* at which the falling edge of the sustain pulse to be applied to sustain electrodes SU1 to SUn ends, switching element Q1 for causing the sustain pulse to be applied to scan electrodes SC1 to SCn to rise is turned on. This structure can provide the first overlap period T×1. The length of the first overlap period T×1 can be adjusted by controlling the timing of time t2*a* and time t5*a*. In the first exemplary embodiment, the length of the first overlap period T×1 is set to 50 nsec.

The sequence of the respective sustain pulses in the present invention is not limited to the sequence shown in FIG. 10. Preferably, the rate of sustain pulses for causing single-peak light emission and sustain pulses for causing double-peak light emission is set optimum for suppressing the phenomenon of afterimage. In the above descriptions, the time periods for causing a sustain pulse to rise and fall, and each specific value shown in the first overlap period T×1 or the like are simply examples. These values can be set optimum for the characteristics of the panel and the specifications of the plasma display device or the like so that the advantage of suppressing the phenomenon of afterimage can be offered.

Second Exemplary Embodiment

A structure of providing the first overlap period T×1 is described with reference to FIG. 10 in the first exemplary embodiment. It is confirmed that the generation of double-peak light emission is further stabilized by providing an overlap period in the time period for causing a sustain pulse having a gentler falling edge to fall (falling period) and the time period for causing a sustain pulse having a gentler rising edge to rise (rising period), according to the light-emitting rate of discharge cells (the rate of lit discharge cells to all the discharge cells). In the second exemplary embodiment, a description is provided of an example of this waveform.

Figure 12:
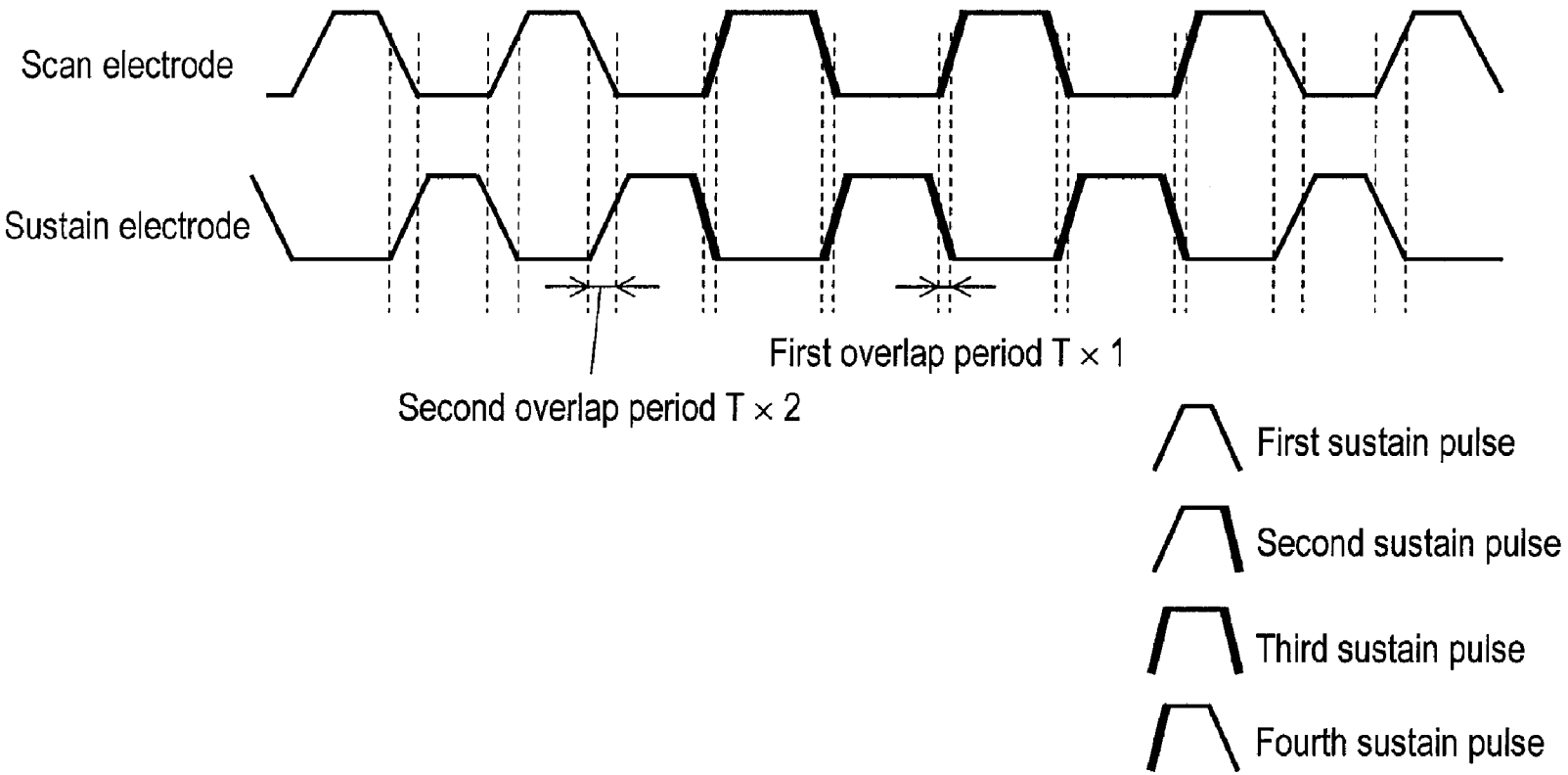
FIG. 12 is a schematic waveform chart showing an example of the sequence of respective sustain pulses in accordance with a second exemplary embodiment of the present invention.

FIG. 12 is a schematic waveform chart showing an example of the sequence of respective sustain pulses in accordance with the second exemplary embodiment of the present invention. In the second exemplary embodiment, an overlap period is provided in the falling period of a sustain pulse having a gentler falling edge and the rising period of a sustain pulse having a gentler rising edge. The other structures are the same as those of the first exemplary embodiment, and thus only the differences are described herein.

In the second exemplary embodiment, as shown in FIG. 12, a second overlap period T×2 is provided in the falling period of a sustain pulse having a gentler falling edge and the rising period of a sustain pulse having a gentler rising edge. Specifically, as shown in FIG. 12, the falling period of a sustain pulse having a gentler falling edge and the rising period of a sustain pulse having a gentler rising edge are placed between the first sustain pulse and the first sustain pulse and between the fourth sustain pulse and the first sustain pulse. The second overlap period T×2 is a period in which the falling period of a sustain pulse is overlapped with the rising period of a sustain pulse.

FIG. 13 is a table showing an example of the relation between light-emitting rates and respective sustain pulses in accordance with the second exemplary embodiment.

In the second exemplary embodiment, as shown in FIG. 13, the first overlap period T×1 is set to approximately 50 nsec irrespective of light-emitting rates. The second overlap period T×2 is set to approximately 100 nsec only in the subfields having a light-emitting rate equal to or larger than 50% and smaller than 85%, and to 0 nsec at the other light-emitting rates.

The discharge current generated during discharge greatly varies with the light-emitting rates. Thus, discharge caused by a sustain pulse having a relatively gentler rising edge for causing double-peak light emission is susceptible to changes in the discharge current, i.e. changes in the light-emitting rate. Experimental results show that the control as shown in FIG. 13, for example, can stabilize the generation of double-peak light emission.

Experimental results also show that the generation of double-peak light emission can further be stabilized by controlling the falling period of a sustain pulse having a gentler falling edge and the rising period of a sustain pulse having a gentler rising edge, according to the light-emitting rates. The falling period of a sustain pulse having a gentler falling edge specifically refers to the falling period of the first sustain pulse and the falling period of the fourth sustain pulse. The rising period of a sustain pulse having a gentler rising edge specifically refers to the rising period of the first sustain pulse and the rising period of the second sustain pulse.

Thus, in the second exemplary embodiment, the falling periods of sustain pulses having a gentler falling edge, more specifically the falling period of the first sustain pulse and the falling period of the fourth sustain pulse, are set to 900 nsec at light-emitting rates equal to or larger than 85%, and to 1,000 nsec at light-emitting rates smaller than 85%. The rising periods of sustain pulses having a gentler rising edge, more specifically the rising period of the first sustain pulse and the rising period of the second sustain pulse, are set to 450 nsec at light-emitting rates smaller than 20%, to 500 nsec at light-emitting rates equal to or larger than 20% and smaller than 50%, and to 550 nsec at light-emitting rates equal to or larger than 50% and smaller than 85%. At light-emitting rates equal to or larger than 85%, the rising periods of these sustain pulses to be applied to scan electrodes SC1 to SCn are set to 550 nsec, and those for sustain electrodes SU1 to SUn are set to 500 nsec. At light-emitting rates equal to or larger than 85%, the rising periods of the sustain pulses to be applied to scan electrodes SC1 to SCn and those for sustain electrodes SU1 to SUn are set different. The reason for this setting is described as follows. The rising waveform of a sustain pulse having a gentler rising edge is more susceptible to the drive load, and there is a large difference between the drive load imposed during driving of scan electrodes SC1 to SCn and the drive load imposed during driving of sustain electrodes SU1 to SUn. This difference is taken into account.

The falling period of the second sustain pulse and the falling period of the third sustain pulse are set to 400 nsec. The rising period of the third sustain pulse and the rising period of the fourth sustain pulse are set to 350 nsec.

Figure 14:
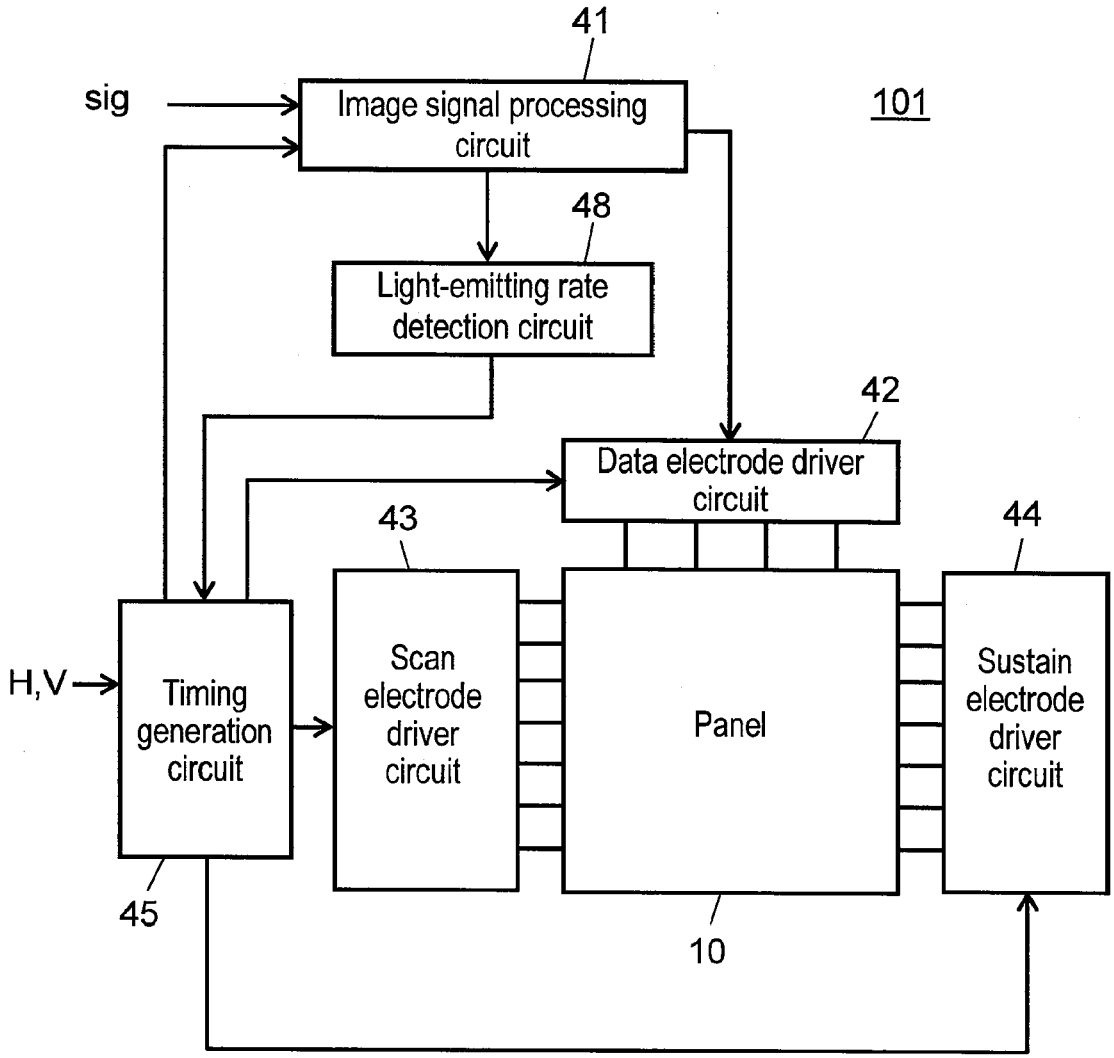
FIG. 14 is a circuit block diagram of a plasma display device in accordance with the second exemplary embodiment of the present invention.

FIG. 14 is a circuit block diagram of plasma display device 101 in accordance with the second exemplary embodiment. Plasma display device 101 of the second exemplary embodiment includes light-emitting rate detection circuit 48 in addition to plasma display device 1 of the first exemplary embodiment shown in FIG. 4. As described above, in the structure of the second exemplary embodiment, timing generation circuit 45 provides a second overlap period T×2 according to the detection results in light-emitting rate detection circuit 48, and changes the rising period of the first sustain pulse, the rising period of the second sustain pulse, the falling period of the first sustain pulse, and the falling period of the fourth sustain pulse. The other operations and the structure of each circuit are the same as those of the first exemplary embodiment.

Light-emitting rate detection circuit 48 detects a rate of the number of lit discharge cells to all the discharge cells, i.e. a light-emitting rate of the discharge cells, for each subfield, according to the image data in each subfield. The detected light-emitting rate is compared with a plurality of predetermined light-emitting rate threshold values and a signal showing the determination result is fed into timing generation circuit 45.

In the second exemplary embodiment, the light-emitting rate threshold values are set to 85%, 50%, and 20%. However, the present invention is not limited to these values and, preferably, values are set optimum for the characteristics of the panel, the specifications of the plasma display device, or the like.

As described above, in the second exemplary embodiment, the second overlap period T×2 is provided according to the light-emitting rates, and the rising period of the first sustain pulse, the rising period of the second sustain pulse, the falling period of the first sustain pulse, and the falling period of the fourth sustain pulse are changed. This structure can further stabilize the generation of double-peak light emission and improve the advantage of suppressing the phenomenon of afterimage.

The specific values shown in the above descriptions are simply examples, and values can be set optimum for the characteristics of the panel, the specifications of the plasma display device, or the like so that the advantage of suppressing the phenomenon of afterimage can be offered.

Figure 15:
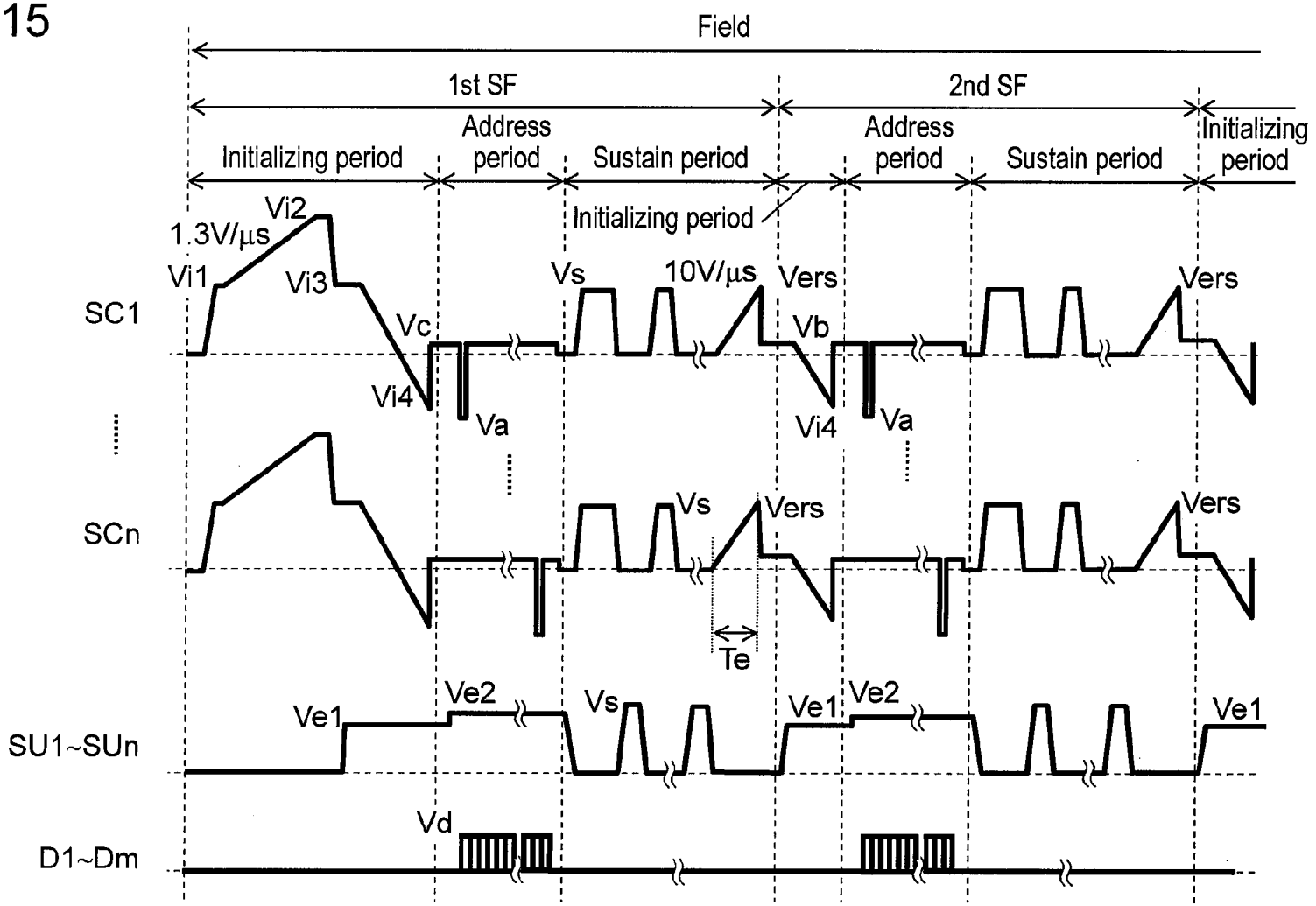
FIG. 15 is a waveform chart showing another example of drive voltage waveforms in accordance with the exemplary embodiments of the present invention.

In the exemplary embodiments of the present invention, immediately after the rising voltage reaches voltage Vers in the erasing ramp waveform voltage, the voltage is dropped to a base potential of 0 (V). However, in order to prevent the above unusual discharge, it is preferable to set the potential to be reached at the voltage drop equal to or smaller than 70% of voltage Vers. FIG. 15 is a waveform chart showing another example of drive voltage waveforms in accordance with the first exemplary embodiment of the present invention. For example, as shown in FIG. 15, immediately after the erasing ramp waveform voltage reaches voltage Vers, the voltage is dropped to voltage Vb (voltage Vb being a voltage equal to or lower than voltage Vers×0.7). This structure can offer the above advantage while preventing the above unusual discharge, even when voltage Vb is kept for a predetermined period of time thereafter.

In the above exemplary embodiments, the lower voltage limit of the potential to be reached at the voltage drop is set to a base potential of 0 (V). The lower voltage limit is a value simply set so that the selective initializing operation can be performed smoothly at the succeeding falling ramp waveform voltage. In the exemplary embodiments of the present invention, this lower voltage limit is not limited to the above value, and can be set to any optimum value within the range in which the operation subsequent to the erasing operation can be performed smoothly.

In the second exemplary embodiment, in a subfield in which the total number of sustain pulses in the sustain period is smaller than a predetermined number of times (five times in this exemplary embodiment) at which a sustain pulse having a steeper rising edge is to be successively generated, only the first sustain pulse can be generated successively. Alternatively, the following structure can be used, in consideration to the fact that generating the first sustain discharge in a sustain period is more difficult than generating the sustain discharge after continuously generating sustain discharge. In this structure, the sustain pulse to be applied to scan electrodes SC1 to SCn first in the sustain period has a waveform shape prioritized for generation of discharge. Next, the second sustain pulse is generated, and thereafter the third sustain pulse is repeated as the remaining sustain pulses.

In the exemplary embodiments of the present invention, scan electrode driver circuit 43 of FIG. 5 and sustain electrode driver circuit 44 of FIG. 6 are simple examples of the structures, and any circuit structure may be used as long as the similar operation can be performed. For example, the circuit for applying voltage Ve1 and voltage Ve2 is not limited to the circuit as shown in FIG. 6. For example, the power supply for generating voltage Ve1, the power supply for generating voltage Ve2, and a plurality of switching elements for applying each voltage to sustain electrodes SU1 to SUn can be used to apply each voltage to sustain electrodes SU1 to SUn at a necessary timing. The circuit for generating the erasing ramp waveform voltage of FIG. 5 is also a simple example of the structure. The circuit can be replaced with another circuit capable of implementing the similar operation.

The exemplary embodiments of the present invention can also be used for a method for driving a panel by so-called two-phase driving, and the advantages similar to the above can be offered. The method for driving a panel by so-called two-phase driving is as follows. Scan electrodes SC1 to SCn are divided into a first scan electrode group and a second scan electrode group. The address period includes the following sub-periods: a first address sub-period in which a scan pulse is sequentially applied to the respective scan electrodes belonging to the first scan electrode group; and a second address sub-period in which a scan pulse is sequentially applied to the respective scan electrodes belonging to the second scan electrode group. In at least one of the first address sub-period and the second address sub-period, a scan pulse that changes from a second voltage higher than a scan pulse voltage to the scan pulse voltage and changes to the second voltage again is sequentially applied to the scan electrodes belonging to the scan electrode group to which the scan pulse is to be applied. Applied to the scan electrodes belonging to the scan electrode group to which no scan pulse is to be applied is one of voltages of a third voltage higher than the scan pulse voltage, and a fourth voltage higher than the second voltage and the third voltage. While the scan pulse voltage is applied to at least adjacent scan electrodes, the scan pulse voltage is at the third voltage.

In the descriptions of the exemplary embodiments of the present invention, the erasing ramp waveform voltage is applied to scan electrodes SC1 to SCn. However, when the last sustain pulse is applied to scan electrodes SC1 to SCn, the erasing ramp waveform voltage can be applied to sustain electrodes SU1 to SUn. However, in the exemplary embodiments of the present invention, preferably, the last sustain pulse is applied to sustain electrodes SU1 to SUn, and the erasing ramp waveform voltage is applied to scan electrodes SC1 to SCn.

In the descriptions of the exemplary embodiments of the present invention, one inductor is used in common to cause a sustain pulse to rise and fall in each of power recovery circuits 51 and 61. However, a plurality of inductors may be used so that one inductor causes a sustain pulse to rise and the other inductor causes the sustain pulse to fall. In this case, the resonance periods may be set as follows, for example. The inductor for the rising has a resonance period of approximately 1,200 nsec, and the inductor for the falling has a resonance period of approximately 1,500 nsec different from that of the inductor for the rising.

The specific values in the exemplary embodiments of the present invention, e.g. the values of voltage Vers, the gradient of the erasing pulse waveform voltage, the rising period and falling period of each sustain pulse, the first overlap period T×1, and the second overlap period T×2, are set according to a 42-inch diagonal panel having 1,080 display electrode pairs used in the experiments, and simply show an example of the exemplary embodiments. The exemplary embodiments of the present invention are not limited to these values and, preferably, values are set optimum for the characteristics of the panel, the specifications of the plasma display device, or the like. For each of these values, variations are allowed within the range in which the above advantages can be offered.

As obvious from the above descriptions, the present invention can provide a plasma display device and a panel driving method capable of alleviating the phenomenon of afterimage, uniformizing the display luminance of respective discharge cells, and providing an excellent image display quality.

Industrial Applicability

The present invention is useful as a plasma display device and a panel driving method capable of alleviating the phenomenon of afterimage, uniformizing the display luminance of respective discharge cells, and providing an excellent image display quality.

The invention claimed is:

1. A plasma display device comprising:

a plasma display panel including a plurality of discharge cells, each of the discharge cells including a display electrode pair formed of a scan electrode and a sustain electrode;

a sustain pulse generation circuit for generating a plurality of sustain pulses and alternately applying the generated sustain pulses to the scan electrode and the sustain electrode of at least one of the plurality of discharge cells in a sustain period, one field period including a plurality of subfields, each of the subfields including an initializing period, an address period, and the sustain period;

a power recovery circuit for causing each of the plurality of sustain pulses to rise or fall by producing a resonance between an interelectrode capacitance of the display electrode pair of the at least one of the plurality of discharge cells and an inductor; and a clamp circuit for clamping a voltage of each of the plurality of sustain pulses to a power supply voltage or a base potential;

wherein, the plurality of sustain pulses includes:

at least one first sustain pulse having a first rise time and a first fall time, that causes two light emission peaks in at least one of the plurality of discharge cells;

at least one second sustain pulse having a second fall time that is less than the first fall time of the at least one first sustain pulse; and at least one third sustain pulse that has a third rise time that is less than the first rise time of the at least one first sustain pulse, and a third fall time that is less than the first fall time of the at least one first sustain pulse, and causes a single light emission peak in at least one of the plurality of discharge cells, wherein the sustain pulse generation circuit, in the sustain period, consecutively:

applies the at least one first sustain pulse to at least one of the scan electrode and the sustain electrode of at least one of the plurality of discharge cells, applies the at least one second sustain pulse to at least one of the scan electrode and the sustain electrode of at least one of the plurality of discharge cells after the first fall time of the at least one first sustain pulse, and applies the at least one third sustain pulse to at least one of the scan electrode and the sustain electrode of at least one of the plurality of discharge cells both during and after the second fall time of the at least one second sustain pulse, such that the at least one third sustain pulse and the at least one second sustain pulse partially overlap each other in time for a first overlap period.

2. The plasma display device of claim 1, further comprising:

a light-emitting rate detection circuit for detecting a light-emitting rate of the discharge cells for each subfield, and comparing the light-emitting rate with a threshold value, wherein, in the sustain period, after applying the first type of sustain pulse a number of times successively, the sustain pulse generation circuit applies the second type of sustain pulse, after applying the second type of sustain pulse, the sustain pulse generation circuit applies the third type of sustain pulse an other number of times successively, and the sustain pulse generation circuit generates a second overlap period between the at least one of the first type of sustain pulse and another one of the first type of sustain pulse and between the at least one of the first type of sustain pulse and the at least one of the second type of sustain pulse, according to the comparison in the light-emitting rate detection circuit.

3. The plasma display device of claim 2, wherein the sustain pulse generation circuit adjusts the rise time of the first type of sustain pulse and the rise time of the second type of sustain pulse, and adjusts the fall time of the first type of sustain pulse, according to the comparison in the light-emitting rate detection circuit.

4. The plasma display device of claim 2, wherein the sustain pulse generation circuit generates the first overlap period and the second overlap period to be different time lengths with respect to each other.

* * * * *